US005153393A

United States Patent [19]

Breed et al.

[11] Patent Number: 5,153,393

[45] Date of Patent: Oct. 6, 1992

[54] CRASH SENSOR FOR A PASSIVE MOTOR VEHICLE OCCUPANT RESTRAINT SYSTEM

[75] Inventors: David S. Breed, 270 Hillcrest Rd., Boonton Township, Morris County, N.J. 07005; Vittorio Castelli, Yorktown Heights, N.Y.; Anthony S. Pruzsenski, Jr., Newbury, Mass.; William T. Sanders, Rockaway, N.J.

[73] Assignee: David S. Breed, Boonton Township, Morris County, N.J.

[21] Appl. No.: 771,831

[22] Filed: Oct. 7, 1991

Related U.S. Application Data

[63] Continuation of Ser. No. 497,343, Mar. 22, 1990, abandoned.

[51] Int. Cl.[5] ..... H01H 35/14

[52] U.S. Cl. ..... 200/61.45 R; 200/61.53

[58] Field of Search ..... 200/61.45 R, 61.53

[56] References Cited

U.S. PATENT DOCUMENTS

| | | | |
|---|---|---|---|
| 2,997,557 | 8/1961 | Gillmor et al. | 200/61.45 M X |
| 3,459,911 | 8/1969 | Fischer | 200/61.45 R |
| 3,737,599 | 6/1973 | Zuvela | 200/61.45 R |
| 4,329,549 | 5/1982 | Bred | 200/61.45 M |
| 4,827,091 | 5/1989 | Behr | 200/61.53 X |
| 4,857,680 | 8/1989 | Janotik | 200/61.53 X |
| 4,873,401 | 10/1989 | Ireland | 200/61.53 X |
| 4,900,880 | 2/1990 | Breed | 200/61.45 M |
| 4,914,263 | 4/1990 | Behr | 200/61.53 X |
| 4,922,065 | 5/1990 | Behr et al. | 200/61.53 X |
| 4,929,805 | 5/1990 | Otsubo | 200/61.53 X |
| 4,933,515 | 6/1990 | Behr et al. | 200/61.53 X |
| 4,995,639 | 2/1991 | Breed | 280/735 |

*Primary Examiner*—J. R. Scott

*Attorney, Agent, or Firm*—Sprung Horn Kramer & Woods

[57] ABSTRACT

A crash sensor for a passive motor vehicle occupant restraint system, such as an inflatable air bag or seat belt tensioner. The crash sensor comprises a tubular passageway having a central, longitudinal axis; a sensing mass arranged to move within the passageway in the direction of the longitudinal axis between a first location and a second location; a device for biasing the sensing mass toward the first location in the passageway; and a device for closing an electrical circuit when the sensing mass moves to the second location in the passageway.

The invention provides methods for reducing the motion of the sensing mass and the tubular passageway in a direction perpendicular to the longitude, and/or methods for reducing the angular momentum of the sensing mass, during motion of the sensing mass in the longitudinal direction.

56 Claims, 32 Drawing Sheets

34

CRASH SENSOR FOR A PASSIVE MOTOR VEHICLE OCCUPANT RESTRAINT SYSTEM

REFERENCE TO RELATED APPLICATION

This application is a continuation of application Ser. No. 07/497,343 filed Mar. 22, 1990, now abandoned.

BACKGROUND OF THE INVENTION

The present invention relates to a crash sensor adapted for installation on an automotive vehicle equipped with a passive occupant restraint device such as an inflatable air bag or seat belt tensioner. When such a vehicle is subjected to deceleration of the kind accompanying a crash, and the crash sensor triggers, the air bag is inflated to provide a protective cushion for the occupant or the seat belt is pulled back against the occupant holding him in a safe position.

Gas damped crash sensors have become widely adopted by many of the world's automobile manufactures for sensing a crash and for initiating the inflation of an air bag or tensioning of seat belts. Sensors constructed from a ball and a tube are disclosed in the U.S. Pat. Nos. 3,974,350, 4,198,864, 4,284,863, 4,329,549, 4,573,706 and 4,900,880 to D. S. Breed. A sensor constructed in the form of a rod with an attached coaxial disk, both arranged to move within a cylinder, is disclosed in the U.S. Pat. No. 4,536,629 to R. W. Diller.

Recently, it has been found that although the sensors disclosed in the Breed patents generally perform well during high speed crashes, their performance deteriorates significantly in marginal crashes, especially when strong cross-axis accelerations are present. One automobile manufacturer requires that the air bag always be deployed during crashes into barriers at 12 mph or above, while not deploying the air bag in crashes into barriers at 9 mph or below. Crash sensors that are designed to meet this criterion, perform well on laboratory shock test equipment. However, when placed on a vehicle and crash tested into a barrier at 12 mph, the sensor frequently either does not trigger at all or it triggers late. In the first case the occupant does not receive the protection of the air bag or belt tensioning device, and in the second case the occupant, who is out of position, is at risk of being injured by the deployment of the air bag.

It has been hypothesized and shown theoretically that there are some conditions in which the sensing ball does not merely roll down one side of the tube but in fact undergoes a rather complicated whirling or orbiting motion. When this happens, a significant amount of energy is dissipated through sliding friction between the ball and the tube. This phenomenon has the effect of substantially delaying the motion of the ball and, on a marginal crash, can lead to a no-trigger or a late trigger condition. A similar condition has been found to exist in sensors having a cylindrical sensing mass traveling in a tube.

Deviations from linear motion are caused by accelerations perpendicular to the longitudinal axis of the sensor tube. In the typical mounting arrangement, the sensor tube axis points toward the front of the vehicle and it is the accelerations in the vertical and lateral directions that can cause the whirling motion described above.

This cross-axis effect is determined, in part, by the friction between the ball and its surrounding cylinder and thus the effect can be substantially reduced by lowering the coefficient of friction through the use of a low friction coating on the ball and/or cylinder surface.

Cross-axis vibrations have other undesirable effects, particularly on the electrical contact design currently used in gas damped ball-in-tube sensors. In particular, since the standard contact is a cantilevered beam, vibrations of the sensor can cause the contacts to vibrate and result in several intermittent "tic" closures before solid contact is achieved. Similarly, when the contacts are first impacted by the sensing mass (i.e. the ball, in the case of the ball-in-tube sensor), they frequently bounce one or more times. In one particular test crash at 14 mph in which significant cross-axis accelerations were present, the ball momentarily bridged the contacts causing a "tic" closure of insufficient duration to reliably trigger the air bag. Although this closure was on time, the air bag was not enabled until much later, once a more solid contact closure had been formed.

The ball-in-tube sensor currently in widespread use has a magnetic bias. Both ceramic and Alnico magnets are used depending upon the amount of variation in bias force, caused by temperature, that can be tolerated. Sensors used in the crush zone of the vehicle, and safing or arming sensors used both in the crush zone and out of the crush zone, can have ceramic magnets since they can tolerate a wide variation in bias force. Alnico magnets are used for the higher biased non-crush zone discriminating sensors where little variation in the bias can be tolerated. If a spring bias is employed in place of the magnetic bias as shown in the U.S. Pat. No. 4,580,810 to T. Thuen, the variation of the bias force with temperature can be practically eliminated. The use of a spring bias can also have the effect of reducing contact bounce and minimizing the effect of cross-axis vibration on the contacts. The U.S. Pat. No. 4,536,629 to R. W. Diller discloses a rod-in-cylinder gas damped crash sensor in which a contact spring is employed to provide a spring bias to the sensing mass. The U.S. Pat. No. 4,116,132 to Bell also uses a spring for bias. These sensors are also susceptible to contact bounce during operation.

The U.S. Pat. No. 4,900,880 to D. S. Breed discloses a spring biased sensor where one contact is used as the biasing spring. Although this design is suitable for some applications, particularly where the travel of the mass is relatively short, a single cantilever spring either becomes excessively long or exhibits a substantial force variation for longer travel sensors such as are currently used in the crush zone locations. Other types of springs such as coil springs, add undesirable frictional forces which deteriorate the sensor performance, especially in the presence of cross-axis vibrations. Also, when the second more rigid contact is flexible, provision must be made to prevent early closure due to vibrational excitations of this contact spring. Ball-in-tube sensors as described in the above referenced patents, and as currently manufactured, exhibit wide manufacturing tolerances due in part to the difficulty in maintaining the precise clearance between the ball and tube. Some means of adjustment or calibration during manufacture is therefore desirable. U.S. Pat. No. 4,116,132 to Bell, shows an adjustment system for application to a band and roller sensor. The same principle of a screw to fix the initial position of the sensing mass can of course be applied to the ball-in-tube as well as other sensors. Such systems require adjustment of the sensor at an early manufacturing stage before final assembly. It would be desirable if such adjustment could take place during the final sensor testing phase.

Some automobile manufacturers have a requirement that crash sensors be testable. At some time, usually during the start up sequence, an electronic circuit sends a signal to the sensor to close and determines that the contacts did close. In this manner, the sensor is operated and tested that it is functional.

SUMMARY OF THE INVENTION

A crash sensor constructed according to this invention comprises a housing adapted to be mounted on the vehicle in a position to sense and respond to deceleration pulses. Within the housing is a body containing a tubular passageway in which is mounted a movable deceleration sensing mass. The sensing mass is movable, in response to a deceleration pulse above a threshold value, from an initial, "home" position along a path leading to a second, "operating" position. At this second position the mass closes a normally open switch that is connected via suitable wiring to the operating mechanism of an inflatable air bag or seat belt tensioner.

A biasing spring or magnet acts on the deceleration sensing mass to bias the latter to its initial position under a preselected force which must be exceeded before the sensing mass may move from its initial position. When the sensing mass is subjected to a deceleration creating an inertial force greater than the preselected biasing force, it moves from its initial position toward its operating position. Movement of the sensing mass is preferably damped, thereby delaying the motion of the sensing mass from its initial position to its operating position, during which time the deceleration must continue to exceed the bias force. When the damping is fluid damping, it is controlled by the clearance between the sensing mass, which in a preferred embodiment is a ball, and the tubular passage. Naturally other types of damping, such as magnetic damping, can be used in addition to, or in place of, the fluid damping, and a cylindrical mass can be used in place of the ball.

According to the present invention, the tubular passageway has a central, longitudinal axis between the first, initial position and the second, operating position, and means are provided for reducing the motion of the sensing mass in a direction perpendicular to the longitudinal axis during motion of the sensing mass in the direction of the longitudinal axis.

Alternately, or in addition, means are provided for reducing the angular momentum imparted to the sensing mass during motion of the sensing mass within the passageway in the direction of the longitudinal axis. The invention thus assures that most of the mechanical energy of the sensing mass is limited to the energy of translational (not angular) motion in the direction of the axis.

According to another feature of the present invention, a spring contact in the form of a modified elastica spring is used to give a relatively constant biasing force on the sensing mass over its travel to contact the second contact. The modified elastica contact spring is shaped to minimize the possibility of inadvertent contact with the second contact due to vibration and to exert little or no side loads on the ball.

According to another feature of the invention, the cylinder in one configuration and the sensor body/cylinder assembly in another configuration, is permitted "substantial" (in excess of 0.05 inches) vertical and lateral movement relative to the vehicle to greatly increase the isolation from cross-axis vibrations.

It is a principal object of the present invention to provide a sensor design with greatly improved isolation from cross-axis vibration.

It is another object of this invention to utilize a contact spring design which is compact and provides a relatively constant bias force on the sensing mass as it moves toward the firing position.

It is another object of this invention to provide for adjustment of the sensor calibration during final testing to reduce the effects of manufacturing tolerances.

It is a further object of this invention to devise a smaller, simpler and less expensive vehicle crash sensor.

Still another object of this invention is to provide a testable feature to ball-in-tube sensors.

Other objects and advantages of the present invention will become apparent from the following description of the preferred embodiments taken in conjunction with the accompanying drawings.

DESCRIPTION OF THE PREFERRED EMBODIMENTS

Figure 1:
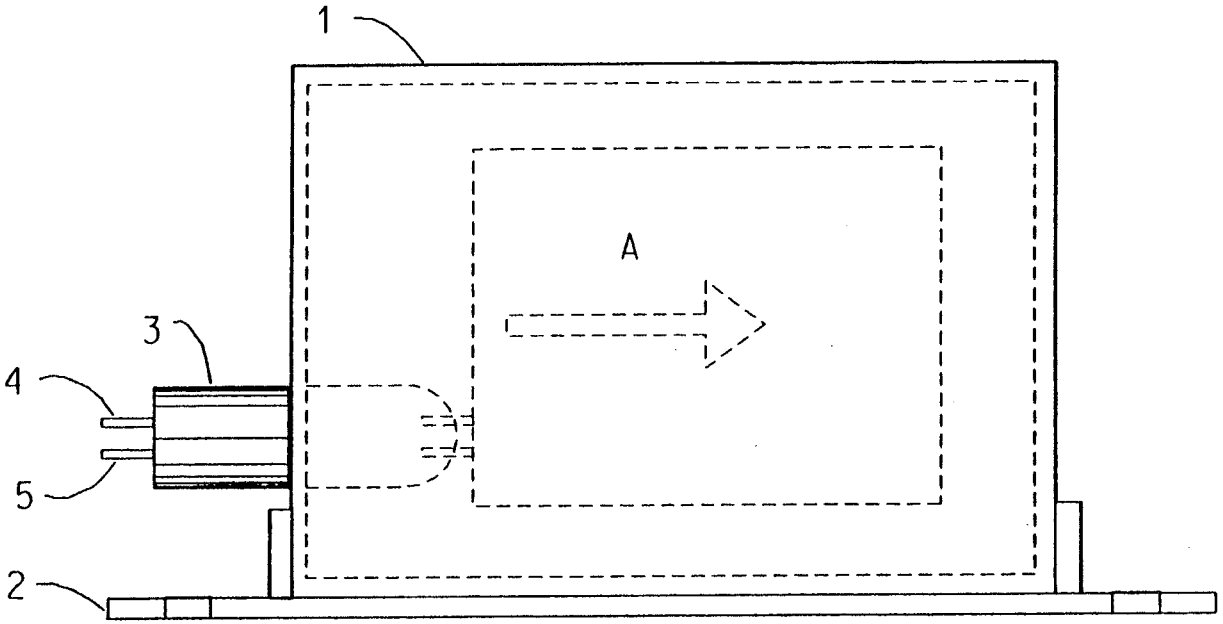
FIG. 1 is an elevational view of sensing apparatus in condition for installation on an automotive vehicle.

Apparatus adapted for use with an automotive vehicle or truck (not shown) and constructed in accordance with one preferred embodiment of the present invention, as illustrated generally in FIG. 1, is accommodated within a closed, metallic housing 1 having a mounting bracket 2 by means of which the housing can be secured to the vehicle. Extending from and secured to the housing is one end of an insulating sheath 3 within which are electrical conductors 4 and 5 that form part of an electrical circuit as disclosed in the aforementioned U.S. Pat. No. 4,329,549 to D. S. Breed. The interior configuration of the housing 1 is complementary to the sensor apparatus so as to snugly retain the latter within the housing. Frequently the housing is filled with epoxy or a sand and epoxy mixture to further retain and seal the sensor within the housing. In other cases, the housing or can is hermetically sealed.

Figure 2:
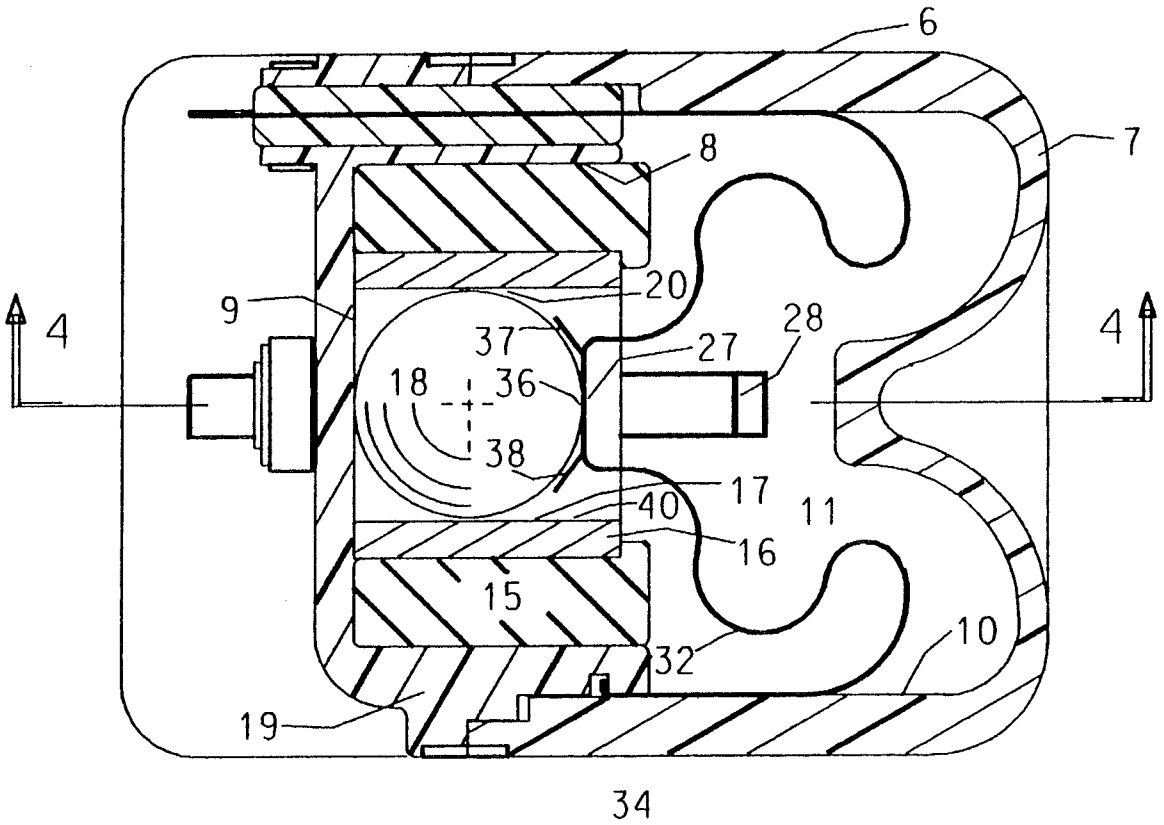
FIG. 2 is a transverse sectional view of sensing apparatus permitting greater excursion of motion of the cylinder to achieve greater cross-axis isolation as well as a low friction coating on the cylinder.

The sensor apparatus is designated generally by reference number 6 in FIG. 2, and comprises a body 7 formed of suitable plastic material and a cylindrical plug 19 formed of electrically insulating material, the plug being fixed in the end of body 7 in any suitable manner, such as by cement, ultrasonic welding, crimping the rim of the skirt, or a combination thereof. Plug 19 has a cylindrical chamber 8 closed at one end by a wall 9. At the other end of the body is an enlarged cylinder skirt 10 defining a cylindrical chamber 11. Communicating with the chamber 11 is a bore 8. Fitted into the bore 8 is a foam rubber vibration isolating sleeve 15 and therein a metallic sleeve 16 having a smooth inner surface forming a tubular passage 17.

Accommodated within the passage 17 is a spherical, metal sensing mass 18, the diameter of which is slightly less than that of the tubular passage 17. Between ball 18 and the tubular passage 17 is a tight clearance 20. When the ball moves along the passage, it causes a pressure difference between the forward and rear sides of the ball. This pressure difference is due to the resistance experienced by the gas in passing through the tight clearance. This gas flow can be viscous, inertial or a mixture of both viscous and inertial type, and it is mainly controlled by the clearance 20 between the ball 18 and cylinder 8. The pressure difference thus applies a resistant damping force on the ball.

Means are provided for applying a spring biasing force on the sensing mass 18, such means comprise a ribbon spring 32 shaped by bending a thin strip of flat metal and attaching it to the body by means of undercut 34. Spring 32 contacts sensing mass 18 at contact point 36 and is prevented from sliding off sensing mass 18 by spring extensions 37 and 38.

Figure 12:
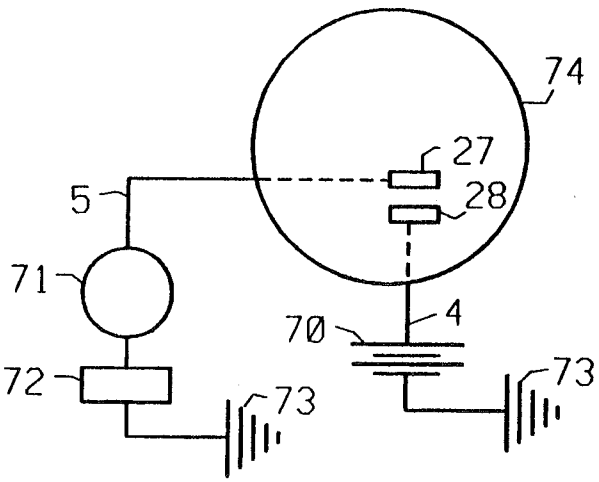
FIG. 12 is a circuit design showing the use of the sensor with an occupant protective system.

To condition the apparatus for operation, the sensor mechanism is fitted into the housing 1 shown in FIG. 1 and the latter is fixed to a vehicle with the longitudinal axis of the passage 17 parallel or at a predetermined angle to the longitudinal axis of the vehicle. FIG. 12 is a schematic drawing of the circuitry. The sensor 74 can be arranged in the circuit with the conductors 4 and 5 connected to the vehicle battery 70, restraint apparatus 71, another series sensor 72 and the circuit grounding 73 as indicated in FIG. 12. Contacts 27 and 28 inside sensor 74 close the circuit when the sensor is triggered.

Figure 3:
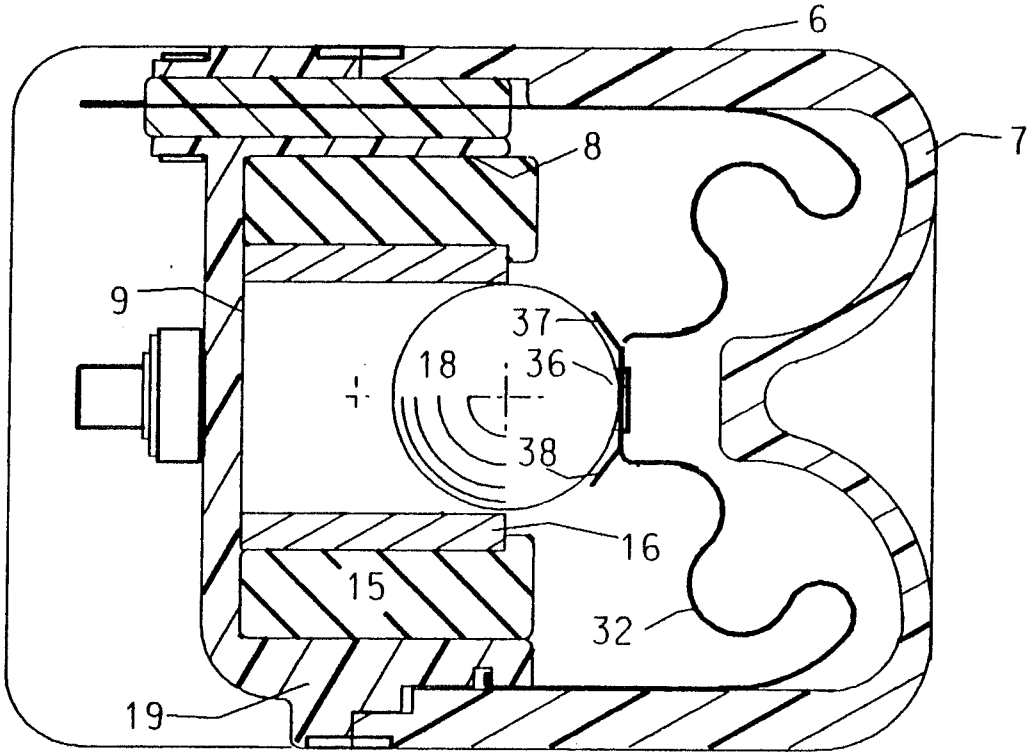
FIG. 3 is a view of the same apparatus of FIG. 2 with the sensing mass in the operational position.

If the vehicle on which the sensor is mounted is traveling in the direction of the arrow A (FIG. 1), the sensing mass 18 will remain in its position until such time as the vehicle experiences a deceleration pulse greater than the biasing force exerted on the mass 18 by the spring 32. If such deceleration pulse is of sufficient magnitude and duration, the sensing mass 18 will move from the position shown in FIG. 2 to an operating position, shown in FIG. 3, in which the mass 18 causes contacts 27 and 28 to contact and complete the electrical circuit, shown in FIG. 12, from the energy source (battery) 70 so as activate the restraint apparatus 71.

At the end of a crash, the ball 18 returns to end wall 9, under the force of spring 32, separating contact 27 from contact 28.

Figure 4:
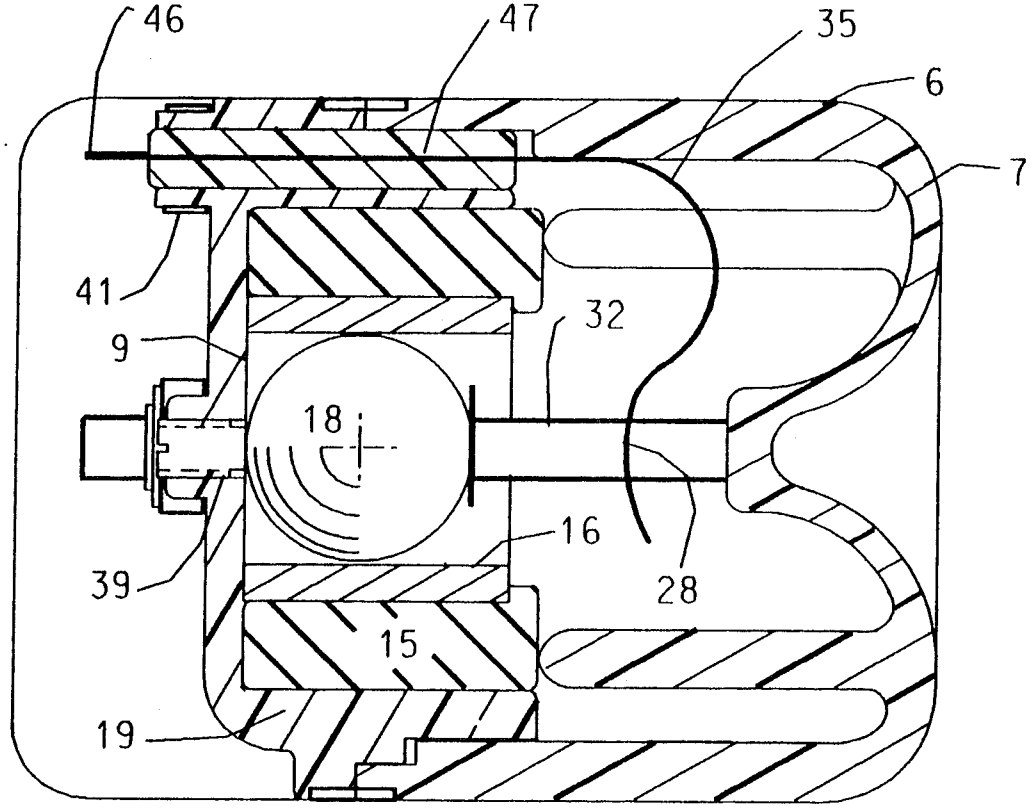
FIG. 4 is a sectional view of the same apparatus of FIG. 2 taken along lines 4—4 showing the second contact and two adjustment means.

As shown in FIG. 4, contact 28 is part of spring 35 which is formed from a similar ribbon material as spring 32. Spring 35 is mounted at right angles to spring 32 to minimize the chance of vibration causing an inadvertent contact closure. The position of spring 35 is adjustable by moving tab 46 inwardly or outwardly through slot 37 in plug 19.

After the sensor is assembled, typically done in a clean room environment, the sensor is tested by subjecting it to a standard acceleration pulse such as a half sinusoid or haversine pulse having a duration of 20 milliseconds and a velocity change of 13 miles per hour. Based on the results of this test, spring 35 can be moved in or out of the sensor through displacing extension 47, thereby allowing contact 28 to be moved relative to contact 27. By this technique, the sensor can be calibrated so that it triggers at precisely the right time during the standard 20 millisecond half sine pulse. This technique of setting the contact 28 relative to the contact 27 allows for the fine tuning or calibration of the sensor in order to eliminate the effects of many of the manufacturing tolerances. Once the sensor has been so tuned, sleeve 41 can be mechanically or magnetically deformed so as to compress the plastic around spring 35 in slot 47, thus effecting the final seal of the sensor.

Since the passageway 47 is both long and fits snugly around spring 35, very little if any contamination can pass into the sensor, which is otherwise hermetically sealed in the clean room. This technique, therefore, permits the final, fine tuning of the sensor to eliminate manufacturing tolerances after the sensor has been fully assembled and during its final testing phase. This technique, therefore, results in a significant improvement in the calibration tolerance of the sensors over the current non-adjustable sensor manufacturing techniques available or even cases where the adjustment is done before final assembly.

Naturally, other methods could be used to adjust the calibration of the sensor, such as adjusting the total travel of the sensing mass 18 by means of an adjustable screw plug, represented in FIG. 4 as a plastic plug 39. Other methods for adjusting the travel of the sensing mass would be obvious to those skilled in the art.

It has been found through computer mathematical modeling of ball-in-tube sensors that the detrimental effects of cross-axis vibration can be substantially eliminated if the vibration isolation system used permits cylinder 16 to move substantially in a radial direction. Substantial motion herein means motion of at least 0.020 inches and preferably as much as 0.050 or 0.070 inches. Vibration isolation member 15 is constructed from closed cell, low density silicone foam rubber. The stiffness of the isolation member 15 is chosen such that the combination of the mass, composed of cylinder 16 and sensing mass 18, and isolation member 15 results in a natural frequency of no more than 200 Hertz and preferably no more that 100 Hertz. It has been found that this combination of both low natural frequency and large permitted excursion substantially eliminates the effects of cross-axis vibrations.

For the crush zone sensor in a typical crash pulse, the main velocity change usually takes place in 20 milliseconds or less as the sensor is impacted by crushed material. For this reason, it may not be necessary to provide isolation from vibrations having sinusoidal periods in excess of 20 ms, or frequencies of 50 Hz or less. A frequency of 50 Hz represents an engine speed of 3,000 RPM, which is not an unusual running speed for an automobile engine. It may be necessary, therefore, to provide damping against engine-induced vibrations for these engine speeds. This will be discussed below in more detail.

The inside of cylinder 17 or the ball 18 can be coated with a low friction coating 40. The presence of this coating also has been found to substantially reduce the effects of cross-axis vibration since these effects act on the ball through the coefficient of friction between the ball and the cylinder. Tungsten disulfide is the preferred coating for this application since its coefficient of friction does not change significantly over large temperature ranges. Teflon based coatings, for example, substantially improve the cross-axis behavior of this sensor at most temperatures, however, the coefficient of friction of Teflon increases substantially when the temperature drops to −40 degrees Fahrenheit, for example. Teflon also, in general, is applied in rather thick layers of 0.001 inches or more, and it is very difficult to apply to the inside of a cylinder without degrading the tolerances. Tungsten disulfide, however, is applied in very thin layers and is easily applied by those skilled in the art and does not degrade the tolerances on the ball and cylinder diameters.

Molybdenum disulfide could also be used for some applications, however tungsten disulfide is preferred since it is more tenacious, less reactive and has a more consistent friction coefficient. Preliminary evidence also shows tungsten disulfide maintains its properties over a wider temperature range.

Spring 32 has been carefully designed to exert a biasing force on sensing mass 18, even though the axis of sensing mass 18 may be substantially displaced from the axis of the housing. Spring 32 has also been carefully designed to minimize the effects of cross-axis vibrations on the performance of the spring and to provide a relatively constant biasing force on sensing mass 18 throughout the travel of this sensing mass.

Figure 5:
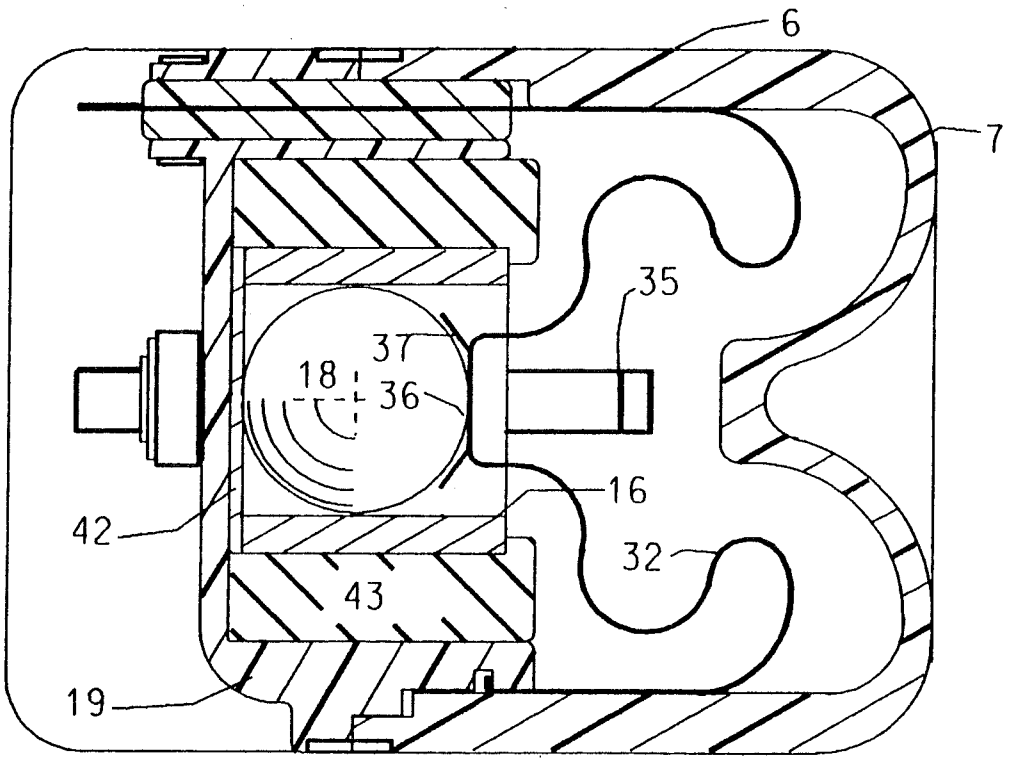
FIG. 5 is a view of the same apparatus of FIG. 2 with a cap on the cylinder and an alternate vibration isolation means.
Figure 6:
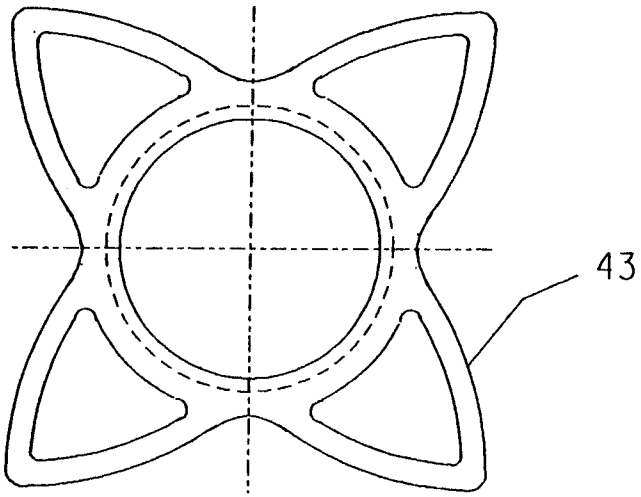
FIG. 6 is a cross sectional view of the vibration isolation means of FIG. 5.

FIG. 5 shows an alternate design of the sensor shown in FIG. 2, wherein the cylinder 16 has an end-cap 42 attached to it by a suitable means such as cement. This design seals the cylinder 16, thus making it unnecessary for this sealing function to be accomplished by isolation damper 43. FIG. 6 shows an alternate form for vibration damper 43 which is now molded from an elastomer, such as Hytrel, in a star shape configuration. This design is easier to make and assemble than the low density foam system used in the embodiments of FIGS. 2–4 and FIG. 5.

Figure 7:
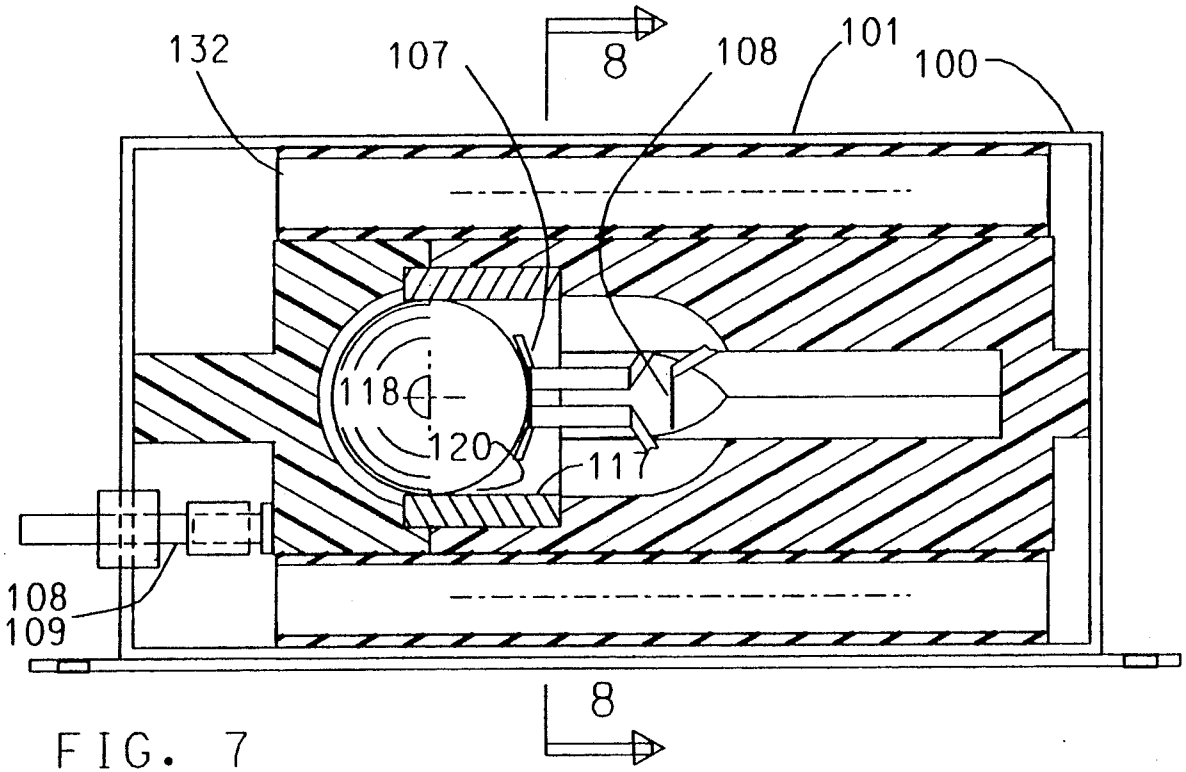
FIG. 7 is a transverse sectional view of an alternate design sensing apparatus permitting greater excursion of the body/cylinder assembly to achieve greater cross-axis isolation.

An alternate preferred embodiment of the sensor (100) is shown in FIG. 7. A contact spring 107 presses on the ball providing the necessary bias. Two wires 108 and 109 are extended outside of the sensor 100 to be connected to the circuitry of the vehicle. The contact spring 107 is connected to one wire 109. During a crash, the ball 118 moves toward the front of the vehicle to the right in FIG. 7, however, its motion is opposed by the contact biasing force and a difference in pressure across the ball 118. This pressure differential is gradually relieved by the flow of the gas through the clearance 120 between the ball 118 and the cylinder 117. The tight clearance will provide a damping effect on the motion of the sensing mass. The force exerted by the contact spring 107 against the ball at all times exceeds the inertial forces caused by vibrations acting on the contact. Thus, the contact 107 always physically touches the ball 118. If the crash is of sufficient severity, ball 118 moves sufficiently to the right bend contact spring 107 to touch contact 108, completing the electrical connection and initiating the safety apparatus.

Figure 8:
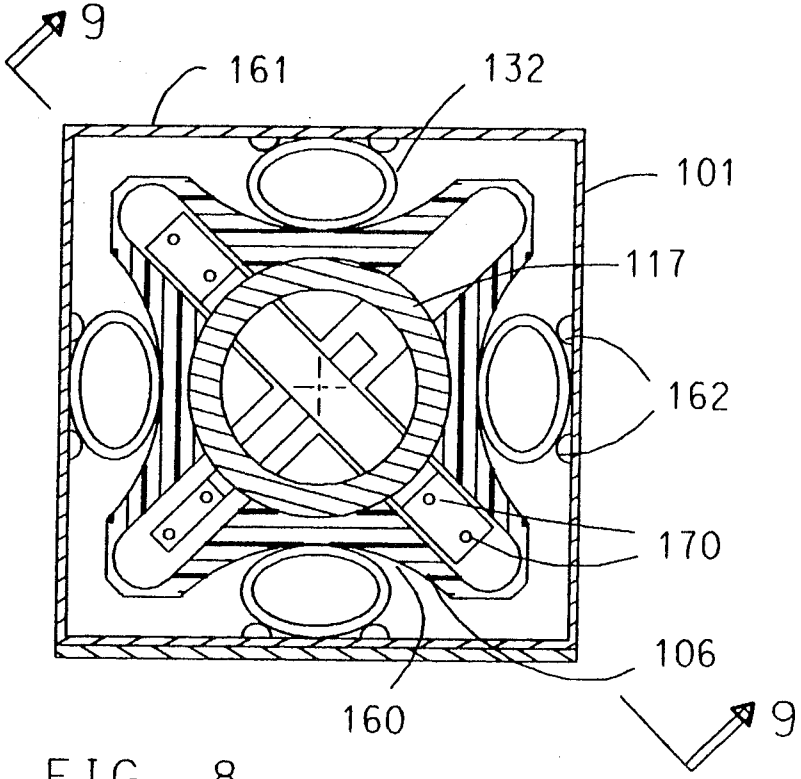
FIG. 8 is a sectional view of the same apparatus of FIG. 7 taken along lines 8—8 showing the vibration isolator.

FIG. 8 shows a cross-sectional view taken along lines of B—B of FIG. 7 and illustrates the cross-axis vibration isolation system employed in this embodiment.

Vibration isolation springs 132 are made from elastomer tubes, 1 inch long and ¼ inch in diameter with 0.010 wall thickness, and are positioned along the axis of the sensor element and are retained by concave sections 160 formed by both the sensor body and walls 161 of the can. Positioned in can walls 161 are a series of dimples or ridges 162 which retain the isolator springs 132, preventing them from sliding along walls 161. The elastomeric tubes 132 are hollow and are formed of a suitable elastomer such as Hytrel as manufactured by DuPont. Hytrel has the advantage that its elastic modulus is quite stable over wide temperature ranges changing by a factor of 2.5 to 1 from minus 40 degrees to plus 160 degrees Fahrenheit as compared with other elastomers which typically vary from 4 to 1 to 10 to 1. The wall thickness of isolator springs 132 is chosen to provide a natural frequency of the sensor element of from 40 to 80 hertz over the temperature range. The overall size of the tubes 132 and the metal can 161 is chosen to permit substantial excursion of at least 0.06 inches for the sensor element during vibration.

The technique of isolating the entire sensor element assembly as practiced in this preferred embodiment has the advantage that the relationship between the biasing spring 107 and the ball 118 is maintained. That is, there is very little relative motion between these two parts. Similarly, the relationship between contacts 107 and 108 is maintained. Thus, the geometrical relationship between all of the internal parts of the sensor does not vary as a result of cross-axis vibrations. By this method, therefore, the overall accuracy of the sensor is significantly improved, resulting in a sensor whose characteristics do not vary significantly when cross-axis vibrations are present.

Contacts 107 and 108 are rigidly attached to the bottom of the sensor housing 106 by any suitable attachment such as rivets 170 or through insert molding techniques, wherein the contacts are fixed into the plastic of body 106 during the injection molding process.

Figure 9:
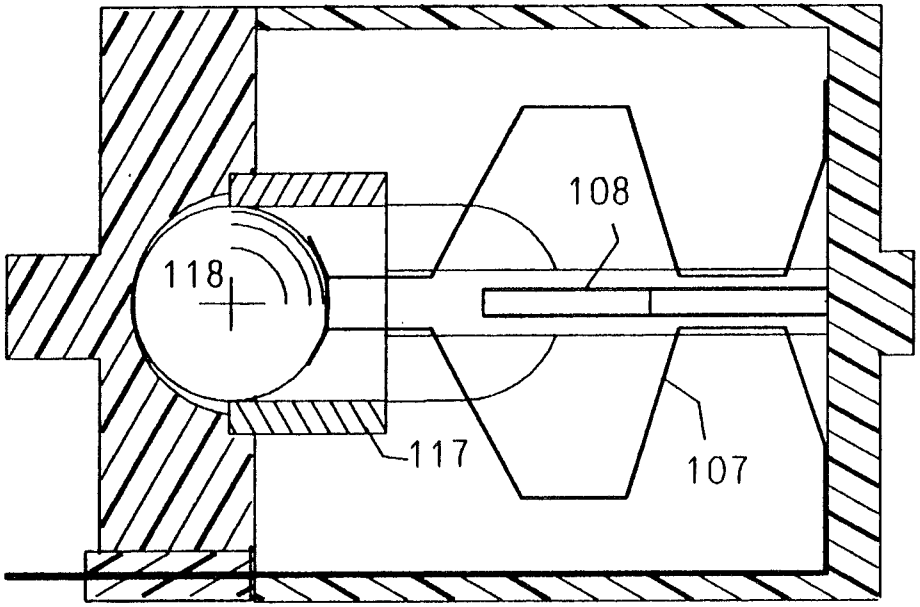
FIG. 9 is a more detailed view of the sensing element of FIG. 8 taken along lines 9—9 without the vibration isolator and environmental can.
Figure 10:
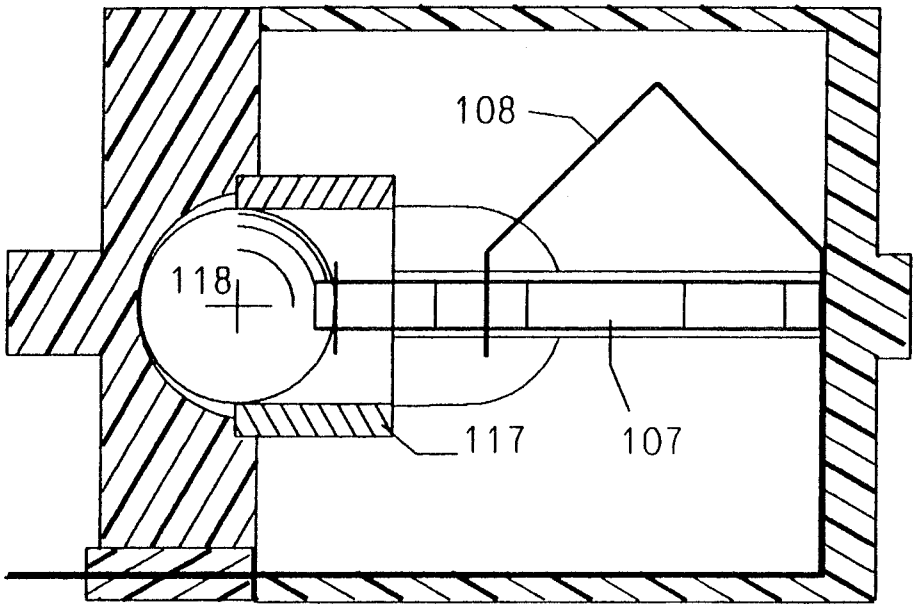
FIG. 10 is a view of the apparatus of FIG. 9 rotated 90 degrees to show the second contact.
Figure 13:
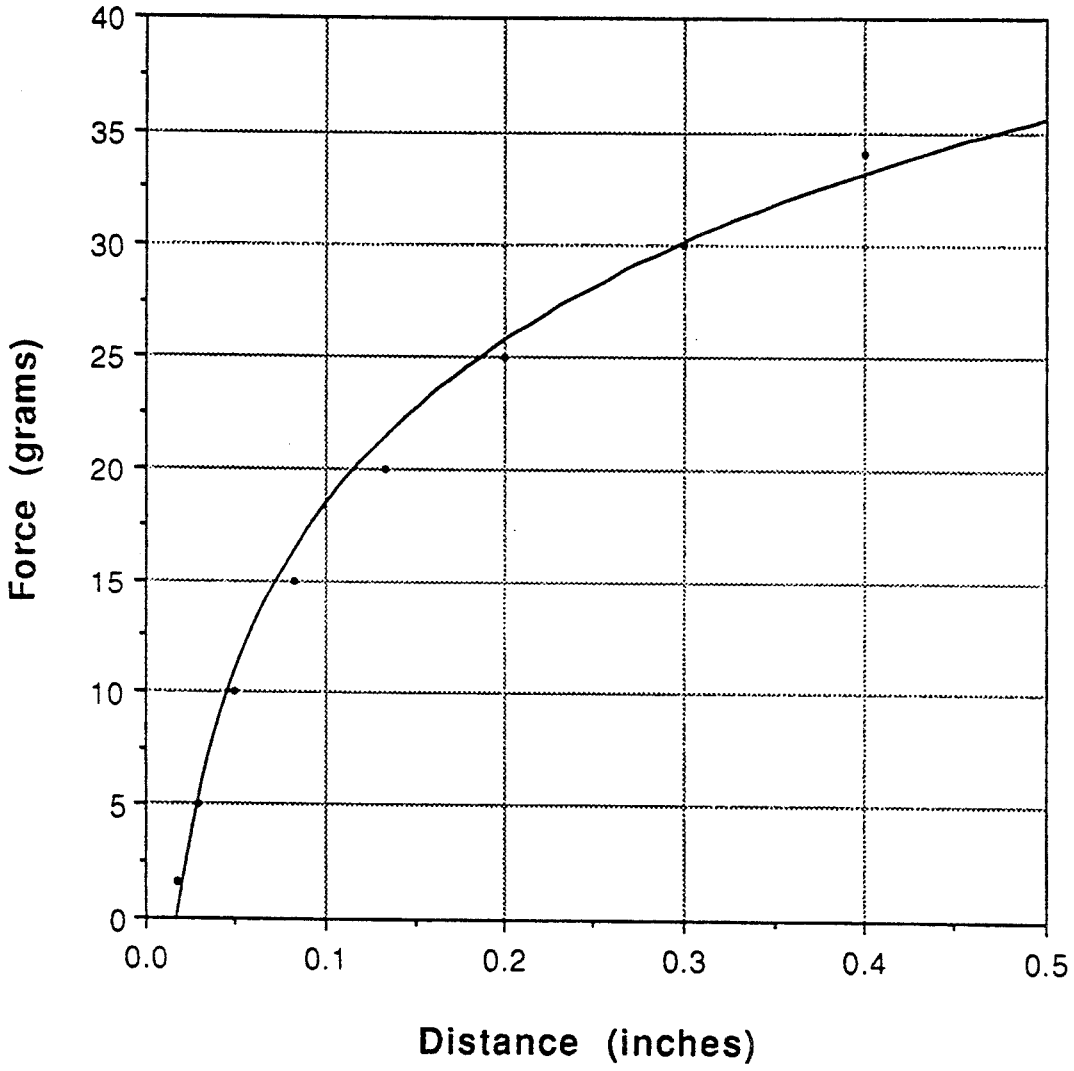
FIG. 13 is a plot of the spring force exerted by the elastica spring shown in FIG. 11 on the sensing mass as a function of the displacement of the mass

FIGS. 9 and 10 show a cross-sectional view of the sensor element of the preferred embodiment shown in FIGS. 7 and 8 and illustrate the contact springs. Contact 107 is formed from a piece of ribbon metal and is patterned after the elastica spring concept. The behavior of an elastica spring is similar to the buckling of a vertical column and has the property that once the buckling has begun, that the force exerted by the spring is nearly constant regardless of the magnitude of the deformation. Spring 107 has some properties of the elastica spring and some properties of a cantilevered beam spring such that the force deflection relationship of this spring as shown in FIG. 13 increases to a certain degree with spring deflection. Upon sufficient travel of the sensing mass 118, spring 107 contacts spring 108 completing the electric circuit. After initial contact, ball 118 continues to move, maintaining contact between springs 107 and 108 for an additional distance to provide for contact dwell.

Figure 11:
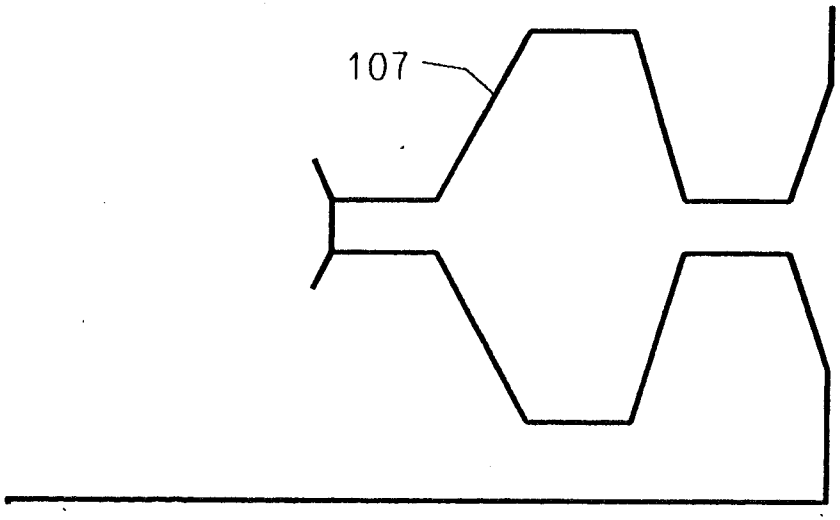
FIG. 11 is a detailed view of the elastica bias and contact spring.

FIG. 11 shows a detail of spring 107 in its formed state prior to installation into the sensor element. FIG. 13 is a graph showing the force versus deflection of spring 107 when installed in the sensor.

Another advantage of the preferred embodiment shown in FIGS. 7 through 10 is that the minimum number of parts are included within the sensor element housing, and with the exception of the rubbing of the sensor mass 118 with its cylinder 117 and spring contact 107, sources of possible contamination are minimized. This is accomplished by, for example, placing the cross-axis vibration isolation system external to the sensor element.

Other features of the preferred embodiment shown in FIG. 2 could, of course, be incorporated into this embodiment, such as a low friction coating on the cylinder or sensing mass and a means for adjusting the travel of sensing mass 118 to substantially reduce the effects of manufacturing tolerances.

The particular configurations shown in the preferred embodiments of this invention permit ease of hermetic sealing, thus eliminating the need for the sand and epoxy potting system currently used on ball and tube sensors. These seals are accomplished through a variety of methods including heat sealing, ultrasonic sealing, solvent sealing, compression sealing through the use of a deformable metallic ring and insert molding, and sealing using chemically treated metallic contacts.

Figure 14:
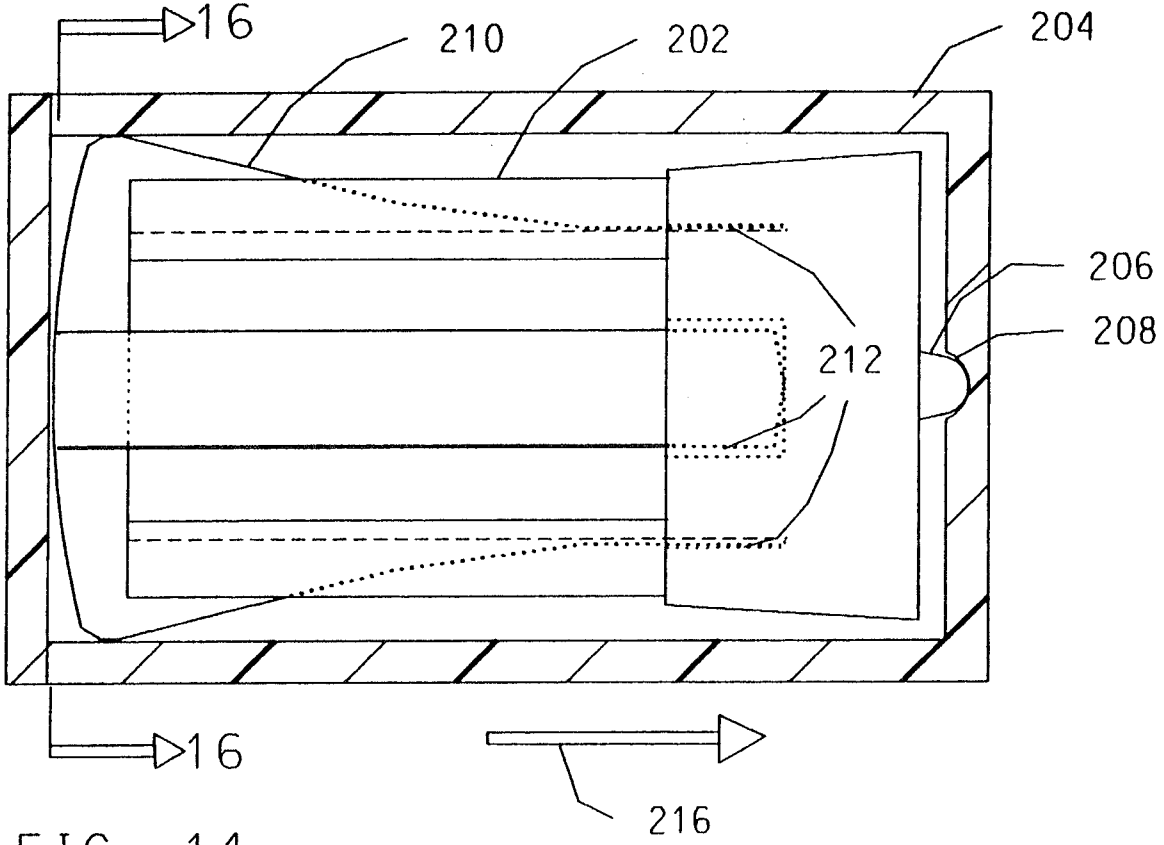
FIG. 14 is a cross sectional view of a crash sensor apparatus with the tubular passageway mounted in pivoted relationship within a housing utilizing a metal isolation spring.
Figure 15:
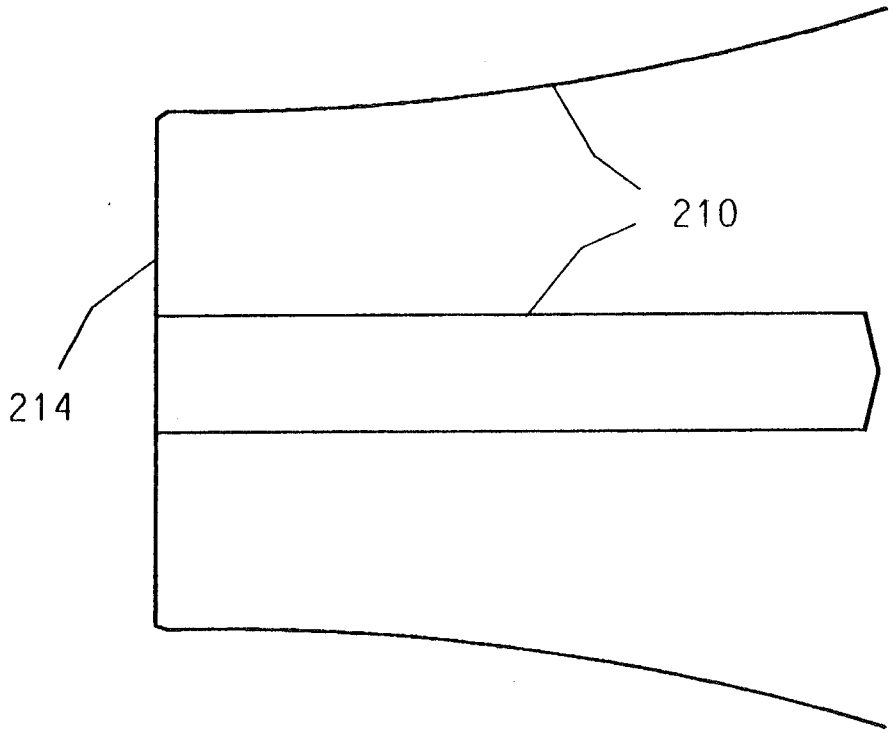
FIG. 15 is a side view of the mounting spring employed in the apparatus of FIG. 14.
Figure 16:
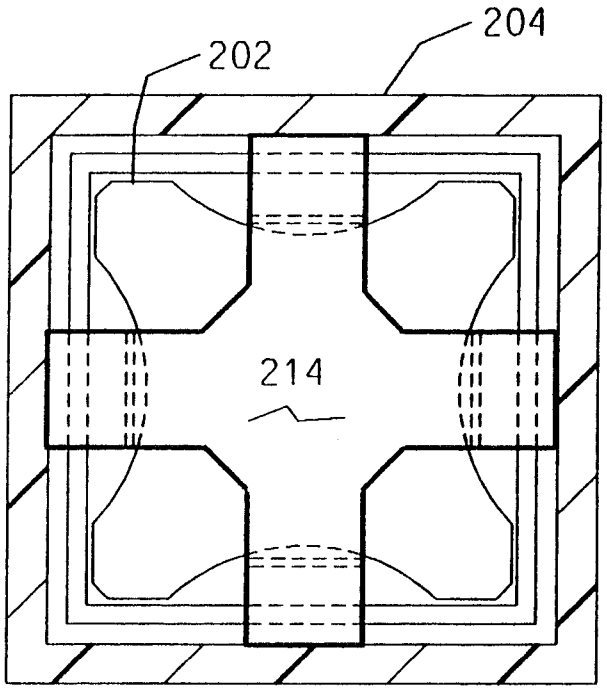
FIG. 16 is an end view of the apparatus of FIG. 14, taken along the line 16—16 in FIG. 14.

FIGS. 14–16 illustrate a ball-and-tube sensor comprising a tubular passageway (cylinder) 202 containing the sensing mass (ball, not shown). The cylinder 202 is mounted within a housing or can 204. The cylinder has an axially extending projection 206 at one end which engages a recess 208 in the can 204. This engagement forms a pivot mount for the cylinder with respect to the can. The pivot mount is located at the end of the cylinder furthest from the initial, "home" position of the sensing mass within the cylinder, that is, closest to the front of the vehicle.

The opposite end of the cylinder is resiliently retained in the can by means of a spring 210, formed of two, transverse, U-shaped flat springs having a common center portion. As may be seen in FIG. 14, this spring fits snugly within the end of the can which is opposite to the pivot mount. The ends of the spring are inserted in slots or pockets 212 in the sides of the cylinder.

The shape of the spring prior to insertion into the can is illustrated in FIGS. 15 and 16. Prior to assembly, the side legs of the spring extend outward away from the cylinder. Bending of these legs into the pockets 212 raises the center portion 214 of the spring which exerts an axial force or preload on the cylinder in the direction of the pivot when the spring and cylinder are assembled into the can.

The embodiment of FIGS. 14–16 provides a resilient mount for the end of the cylinder that faces in the direction of motion of the vehicle (indicated by arrow 216). This mount thus substantially reduces cross-axis vibrations in the region of the cylinder in which the sensing mass moves.

Figure 17:
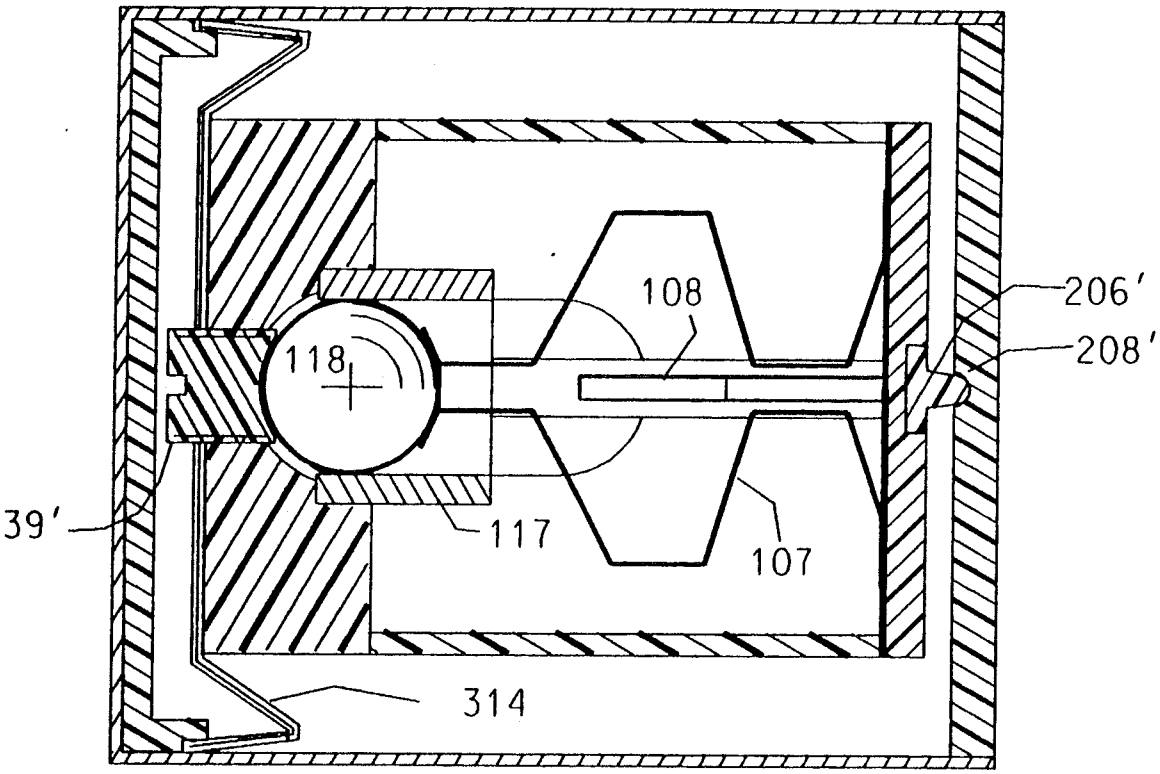
FIG. 17 is a cross sectional view of a crash sensor apparatus with the tubular passageway mounted in pivoted relationship within a housing utilizing an elastomer isolation spring.
Figure 18:
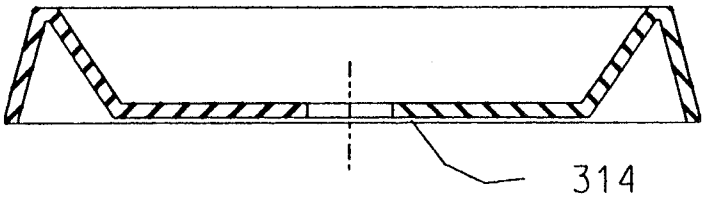
FIG. 18 is a side view of the mounting spring employed in the apparatus of FIG. 17.

FIGS. 17 and 18 show an alternate spring design to that shown in FIGS. 14–16. Spring 314 is molded from an elastomer such as silicone rubber or Hytrel. Pivot point 206' and pivot hole 207' perform the same function as corresponding parts 207 and 208 of FIG. 14. Adjustment screw 39' performs the same function as corresponding part 39 in FIG. 4.

Figure 19:
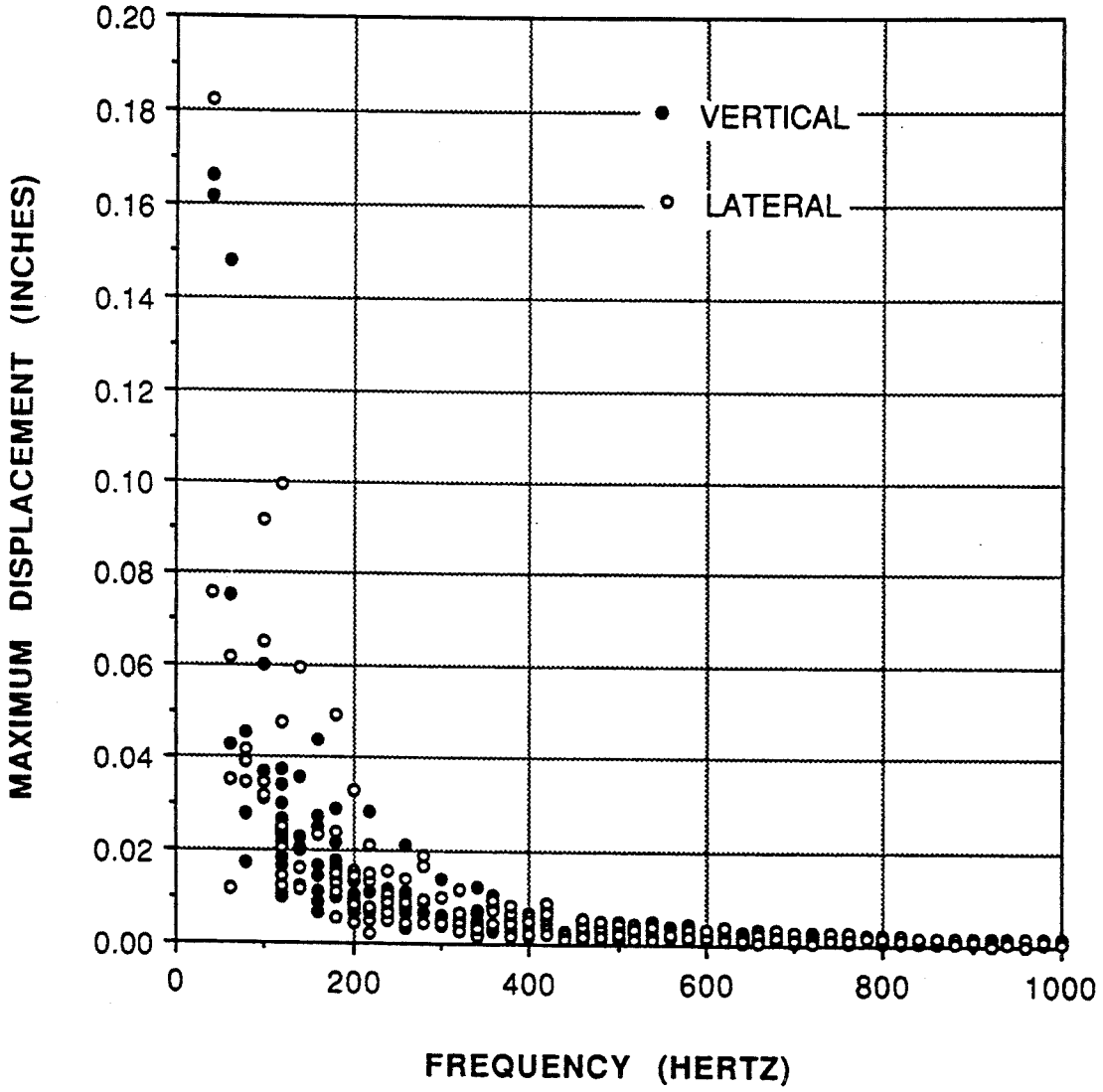
FIG. 19 is a plot of the displacement of the crush zone sensor in a series of frontal crashes versus frequency.

FIG. 19 is a diagram of experimental data showing the maximum displacement of sinusoidal excitations as a function of frequency. As may be seen, the lateral displacements in the region above 100 Hertz sometimes exceed 0.050 inches, but rarely 0.08 inches. Consequently, the resilient mounting of the cylinder, either within a can or directly on the motor vehicle, must permit motion of the cylinder in a direction perpendicular to its longitudinal axis of at least 0.05 inches and preferably in excess of 0.08 inches.

Figure 20:
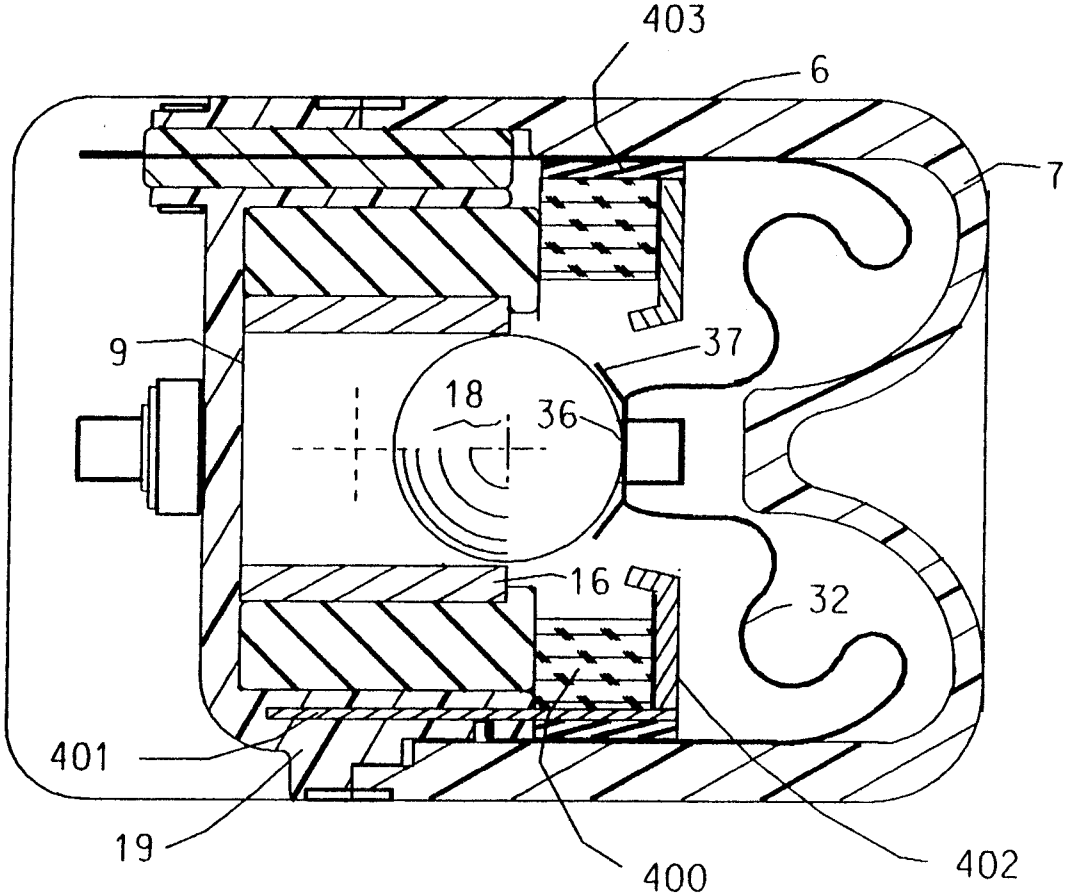
FIG. 20 is a view of the sensor of FIG. 2 with the addition of a testable feature.

In FIG. 20, an electro magnet 400 and associated magnetic circuit structure 401 and 402, has been added to the sensor of FIG. 2. When an electric current flows through coil 400, sensing mass 18 is attracted to pole piece 402. Element 401 serves to guide the flux lines and improve the magnetic circuit. In this manner, the sensor can be tested by some electronic circuit, on engine start up for example, to see that it is operable.

Figure 21A:
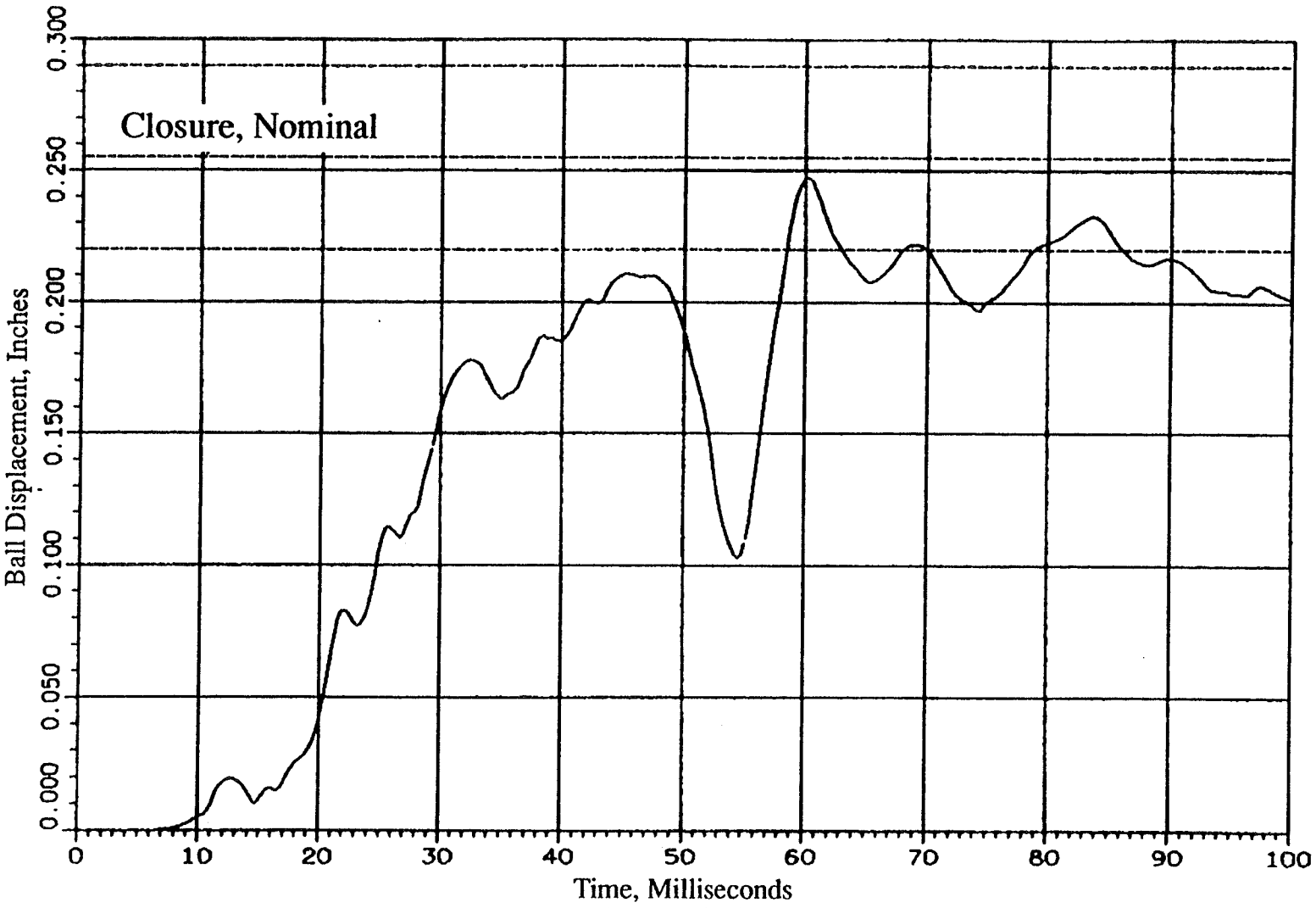
FIG. 21*a* is a plot of the motion of the sensing mass of the sensor of FIG. 17 with standard isolation (natural frequency=350 Hz) when subjected to a typical 14 MPH crash.
Figure 21B:
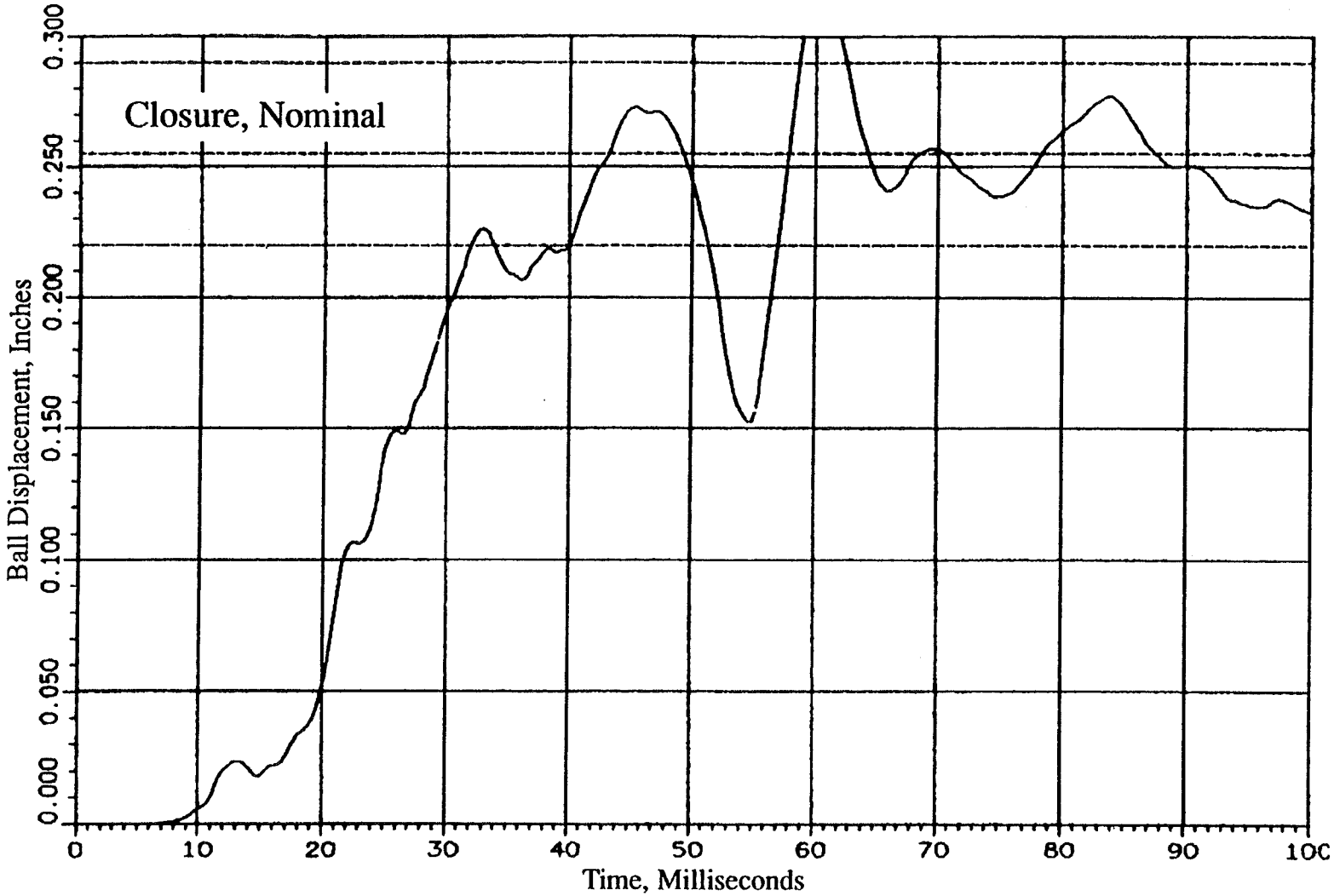
FIG. 21*b* is a plot of the motion of the sensing mass of the sensor of FIG. 17 with isolation which permits a cylinder motion of 0.05 inches with isolation natural frequency of 100 Hz and isolation damping of 30% of critical, when subjected to a typical 14 MPH crash.
Figure 21C:
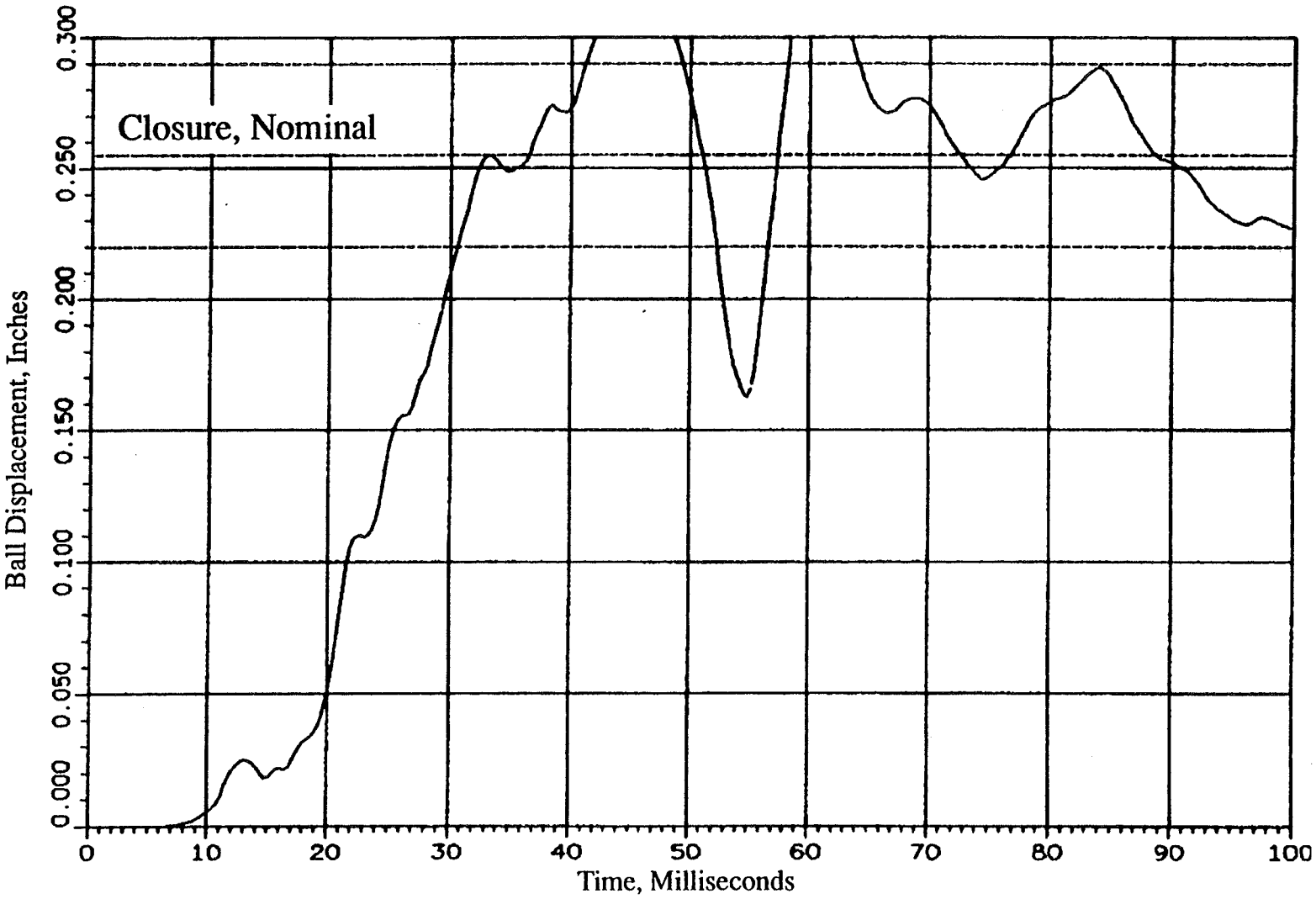
FIG. 21*c* is a plot of the motion of the sensing mass of the sensor of FIG. 17 with isolation which permits a cylinder motion of 0.03 inches with isolation natural frequency of 50 Hz. when subjected to a typical 14 MPH crash.
Figure 21D:
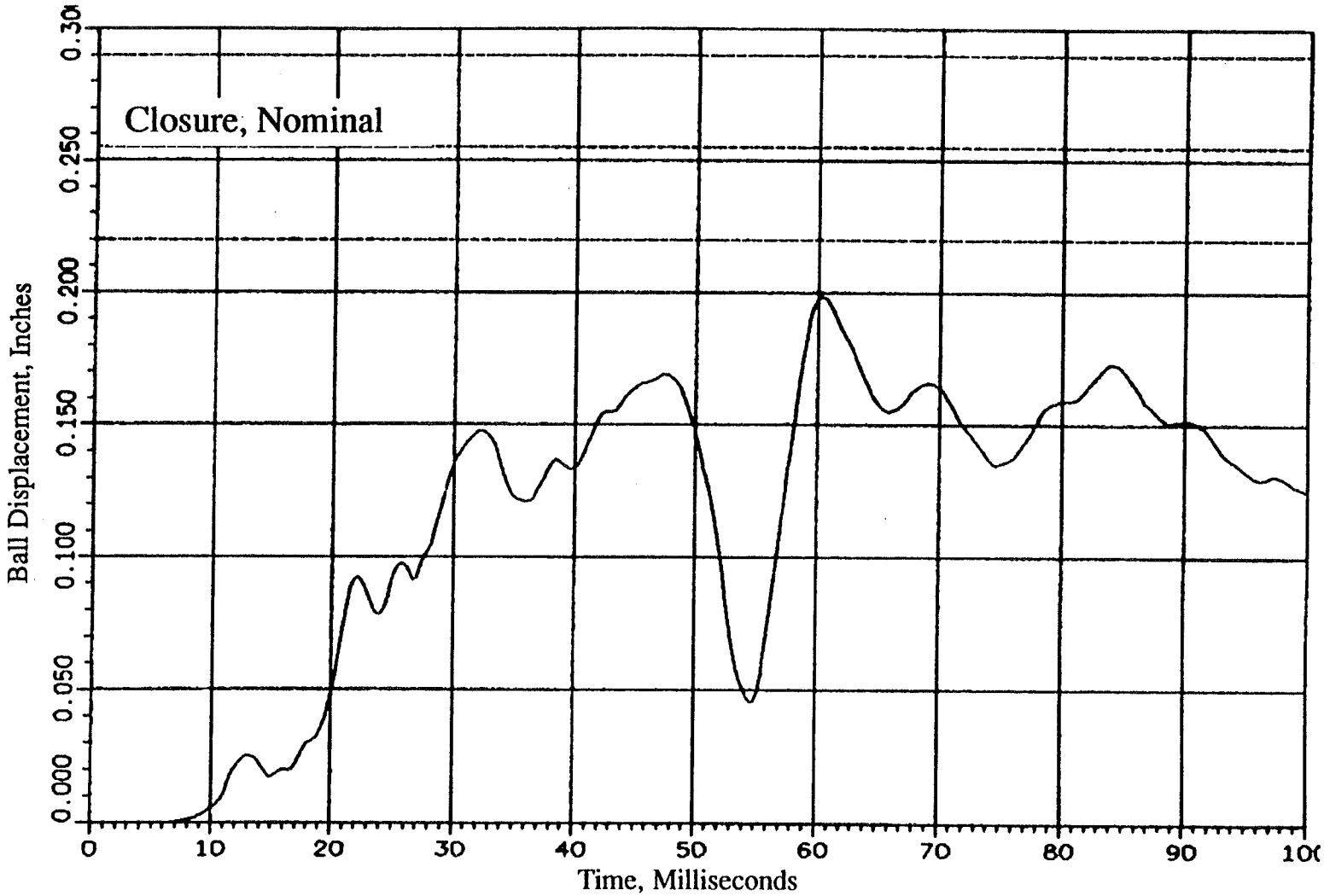
FIG. 21*d* is a plot of the motion of the sensing mass of the sensor of FIG. 17 with isolation which permits a cylinder motion of 0.01 inches with isolation natural frequency of 50 Hz. when subjected to a typical 14 MPH crash.
Figure 21E:
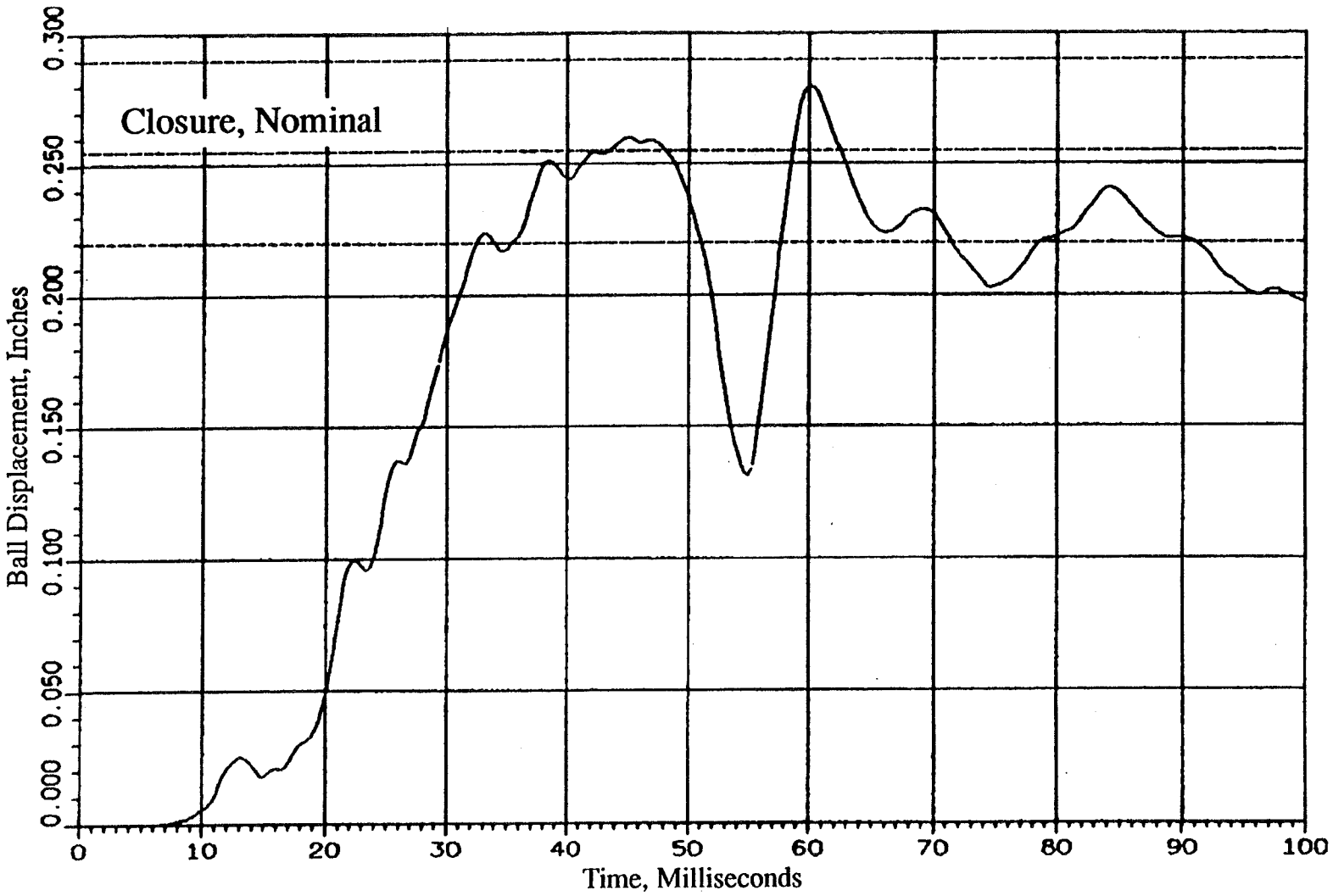
FIG. 21*e* is a plot of the motion of the sensing mass of the sensor of FIG. 17 with isolation which permits a cylinder motion of 0.02 inches with isolation natural frequency of 50 Hz. when subjected to a typical 14 MPH crash.

FIG. 21*a* shows a plot of the motion of the sensing mass versus time of the sensor of FIG. 17, when subjected to a typical 14 MPH crash, with the isolation which appears on the standard ball-in-tube sensors currently in wide spread use. This isolation system has a natural frequency of about 350 Hz at ambient temperature. It can be seen that this sensor does not trigger since the ball travel did not cross the dotted line which indicates triggering. In FIG. 21*b* the same sensor sensing mass motion is plotted for the same crash wherein greater isolation is provided. In this case isolation is used which permits a cylinder motion of 0.05 inches with isolation natural frequency of 100 Hz and isolation damping of 30% of critical. In FIG. 21*c* the isolation natural frequency is reduced to 50 Hz and the isolation maximum excursion is reduced to 0.03 inches. In both cases of FIGS. 21*b* and 21*c* the sensor triggered. In FIG. 21*c* a longer contact dwell and a stronger triggering was achieved indicating that cross-axis vibrations were still effecting the sensor performance when the isolation natural frequency was 100 Hz. Even the reduction of the permitted excursion to 0.03 inches had little effect on sensor performance. In FIG. 21*d*, the permitted excursion was reduced to the standard value of 0.01 inches and once again the sensor failed to trigger. In FIG. 21*e* the permitted excursion was increased to 0.02 inches causing the sensor marginally trigger.

Figure 21F:
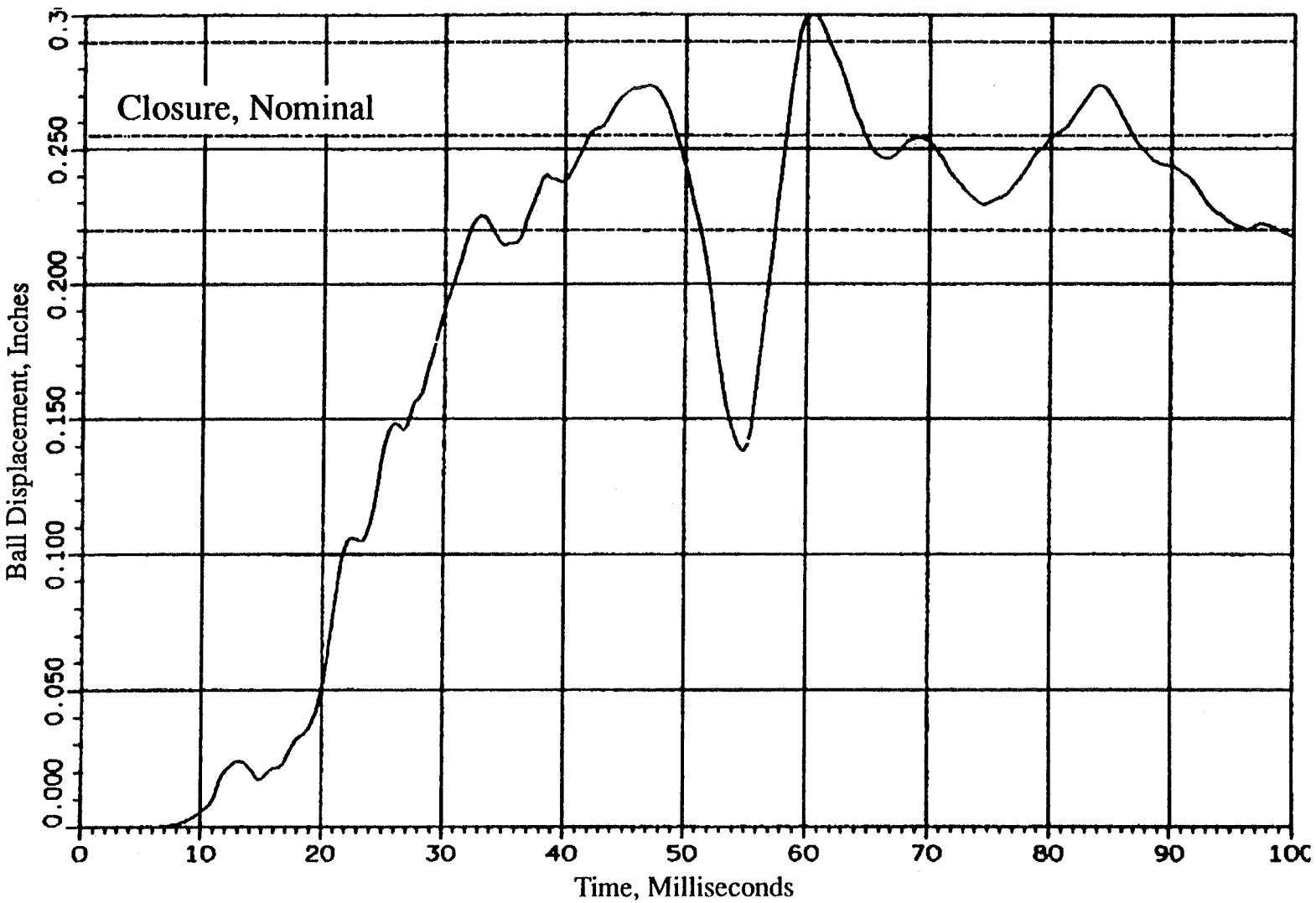
FIG. 21*f* is a plot of the motion of the sensing mass of the sensor of FIG. 17 with isolation which permits a cylinder motion of 0.02 inches with isolation natural frequency of 50 Hz. and a isolation damping of 75% of critical, when subjected to a typical 14 MPH crash.

With such a low isolation natural frequency of 50 Hz, there is a possibility that the sensor would resonate due to engine-induced vibrations. For some applications, therefore, increased damping would be required. FIG. 21*f* shows the effect of greatly increasing the damping to 75% of critical. It is unlikely that this large amount of damping would be required. However, even with this damping, a strong sensor trigger was achieved. This level of damping can be achieved through loading of the elastomer compounds with fillers as is well known to those skilled in the art of rubber molding.

FIGS. 21*a–f* examined the effect of various parameters on a single marginal crash. Naturally the results would differ somewhat quantitatively on different crashes and, as seen in FIG. 19, larger permitted excursion is sometimes required. FIGS. 22*a–d* is an attempt to get a more general understanding of the phenomena.

Figure 22A:
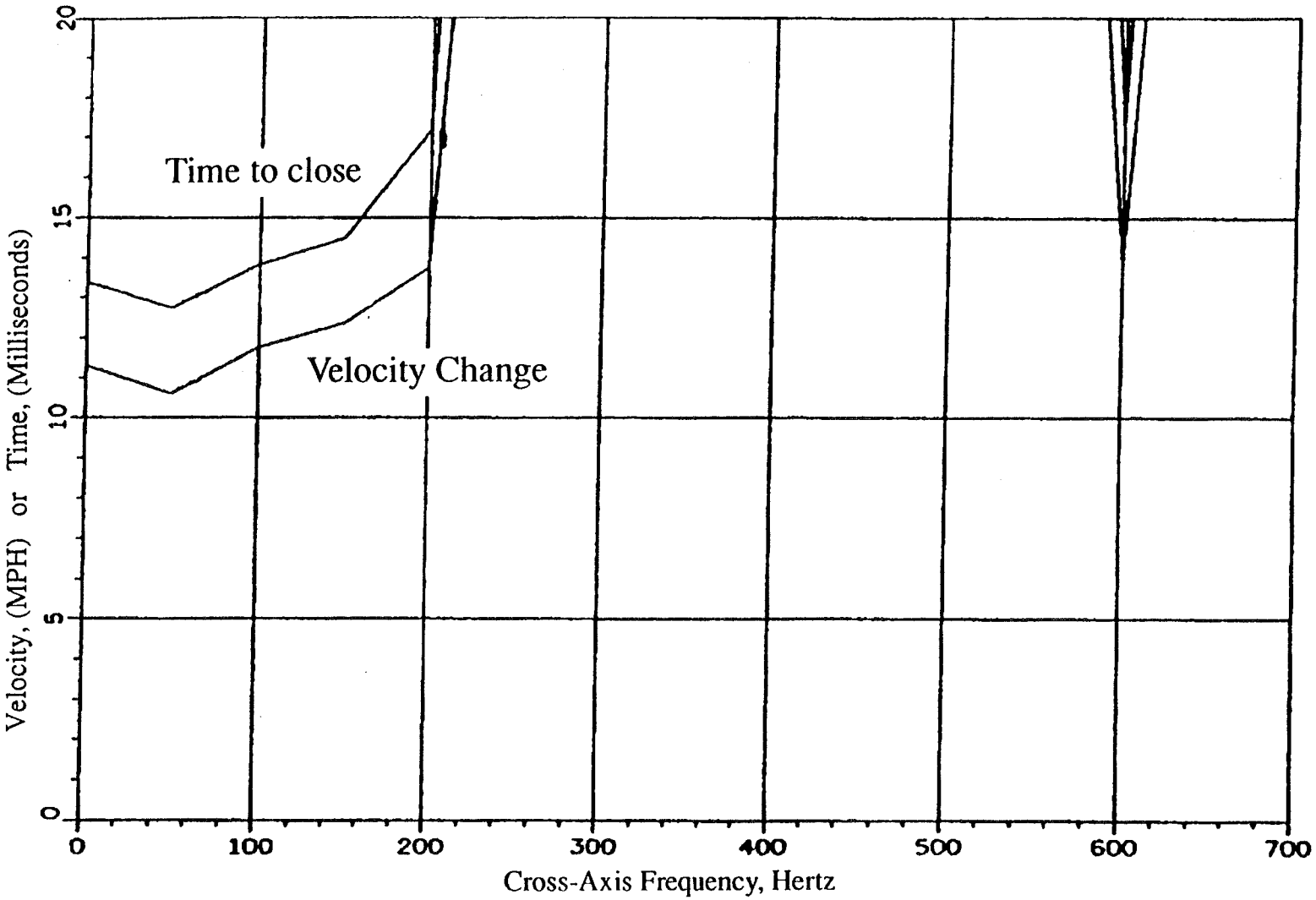
FIG. 22*a* is a plot of the velocity change and time to close (trigger) of the sensor of FIG. 17 with standard isolation (natural frequency =350 Hz) when subjected to a haversine acceleration pulse having a period of 20 milliseconds and a velocity change of 14 MPH, and varying cross-axis frequencies and a magnitude of 100 G's.

FIG. 22*a* is a plot of the velocity change and time to close of the sensor of FIG. 17 with standard isolation having a natural frequency=350 Hz when subjected to a haversine acceleration pulse having a period of 20 milliseconds and a velocity change of 14 MPH and a single-frequency cross-axis vibration. The horizontal axis represents variations in the cross-axis frequency. In all cases the magnitude of the cross-axis was kept at 100 G's. From FIG. 22*a*, which is representative of the standard ball-in-tube sensor, the sensor would not trigger on the 14 MPH pulse for cross axis frequencies from about 200 Hz to about 600 Hz. This plot shows the dramatic effect of cross-axis vibrations on this sensor.

Figure 22B:
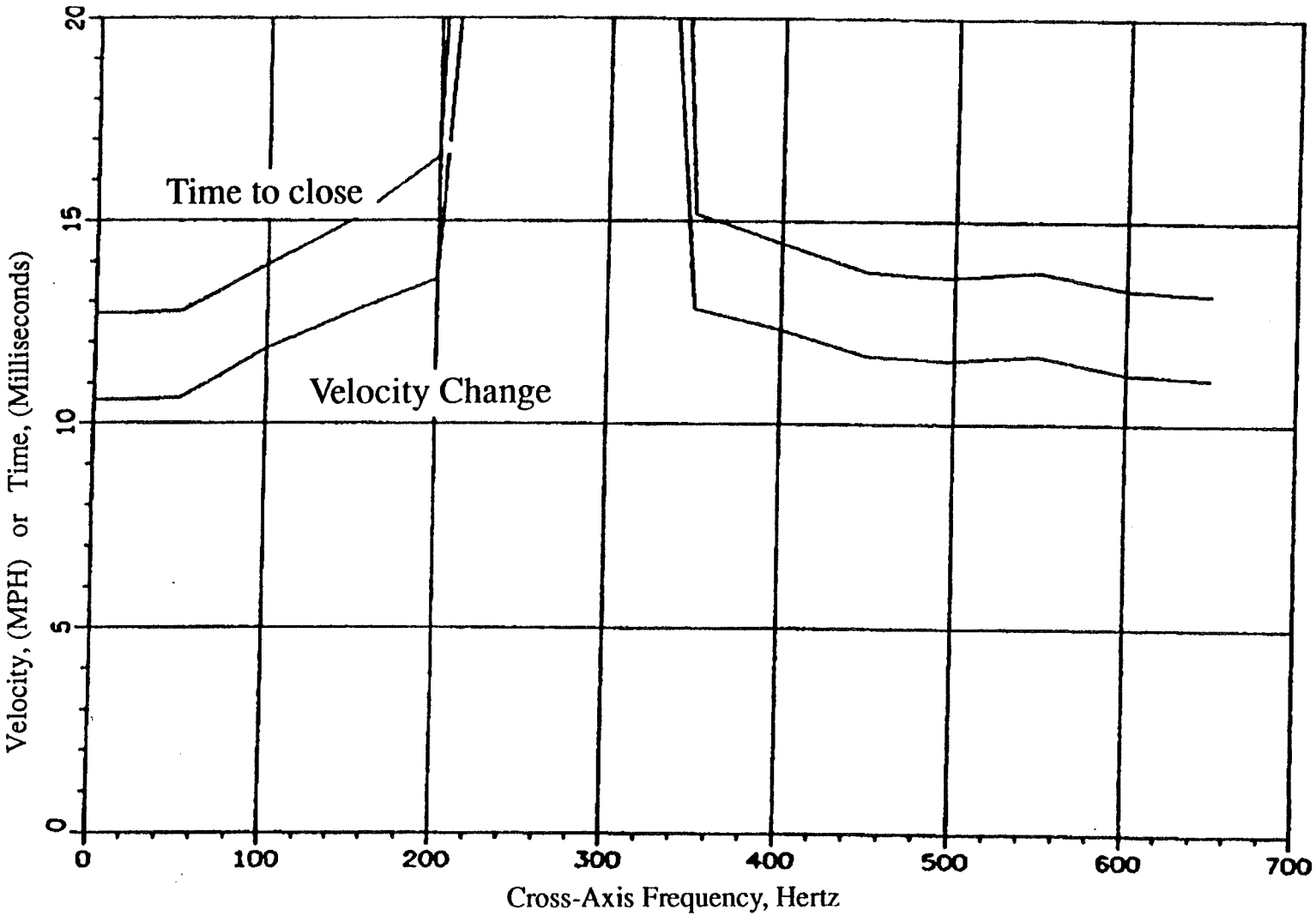
FIG. 22*b* is a plot of the velocity change and time to close of the sensor of FIG. 17 with isolation frequency of 200 Hz and cylinder excursion of 0.05 inches, when subjected to a haversine acceleration pulse having a period of 20 milliseconds and a velocity change of 14 MPH, and varying cross-axis frequencies and a magnitude of 100 G's.
Figure 22C:
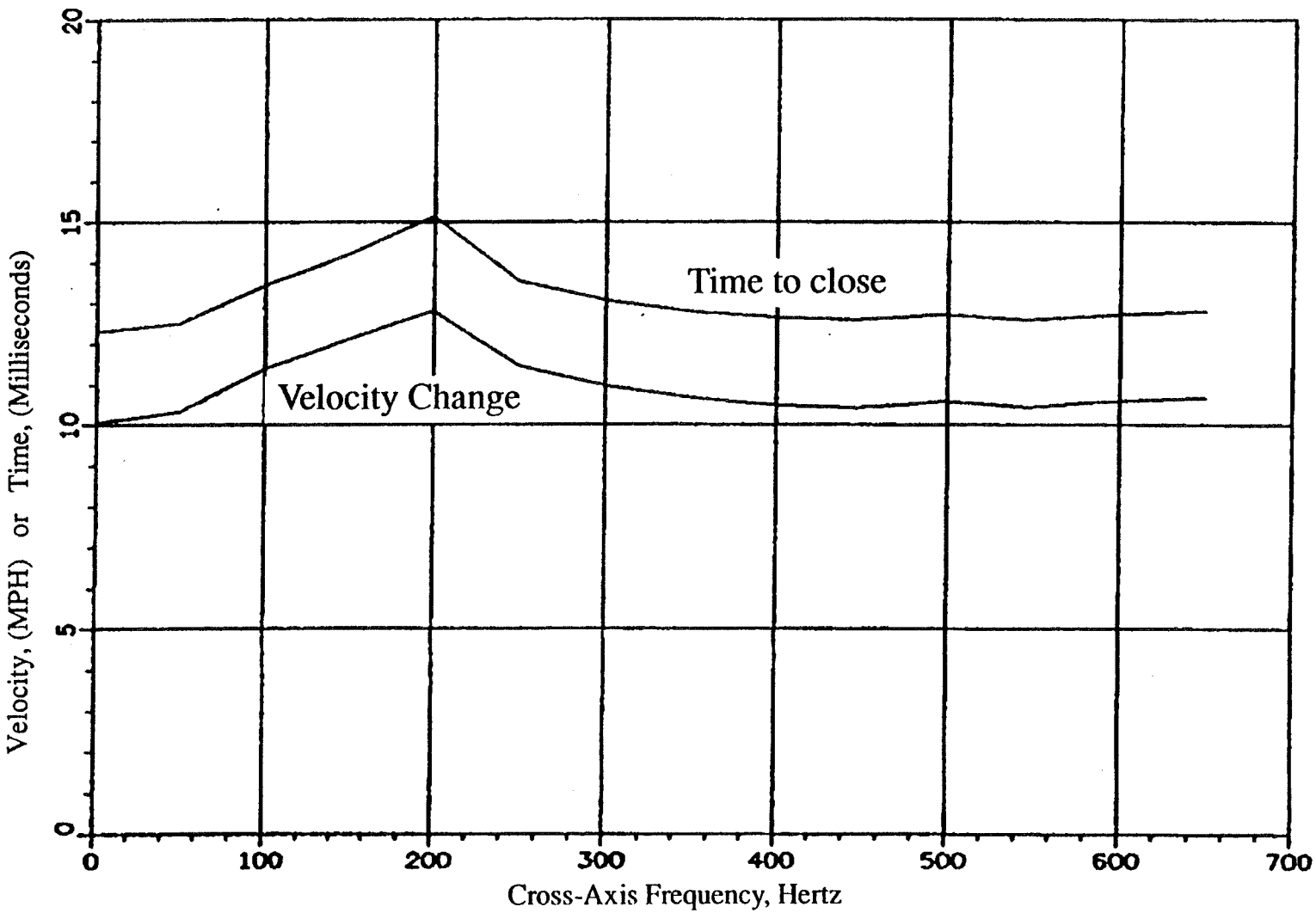
FIG. 22*c* is a plot of the velocity change and time to close of the sensor of FIG. 17 with isolation frequency of 100 Hz and cylinder excursion of 0.05 inches, when subjected to a haversine acceleration pulse having a period of 20 milliseconds and a velocity change of 14 MPH, and varying cross-axis frequencies and a magnitude of 100 G's.
Figure 22D:
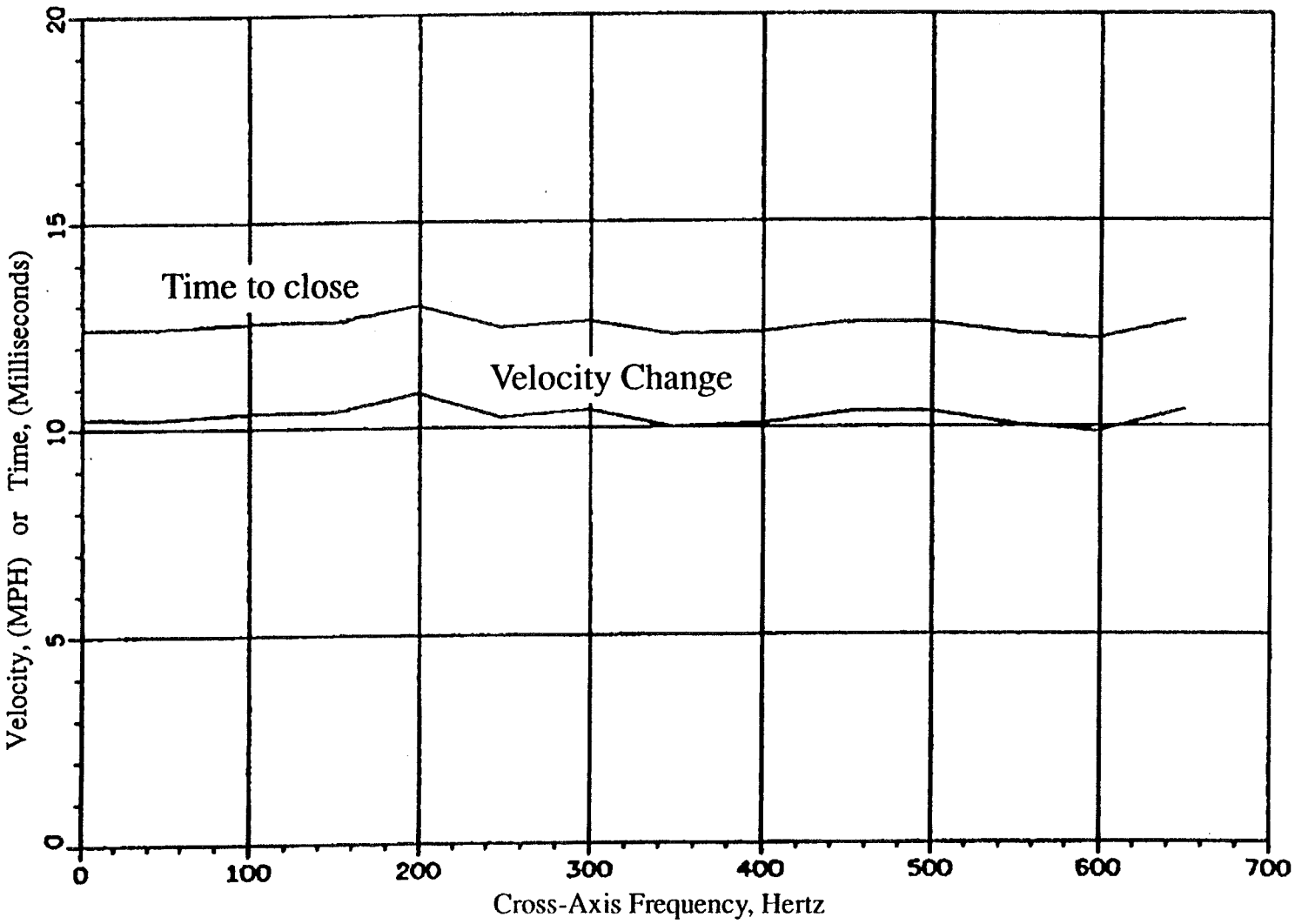
FIG. 22*d* is a plot of the velocity change and time to close of the sensor of FIG. 17 with isolation frequency of 50 Hz and cylinder excursion of 0.05 inches, when subjected to a haversine acceleration pulse having a period of 20 milliseconds and a velocity change of 14 MPH, and varying cross-axis frequencies and a magnitude of 100 G's.
Figure 22E:
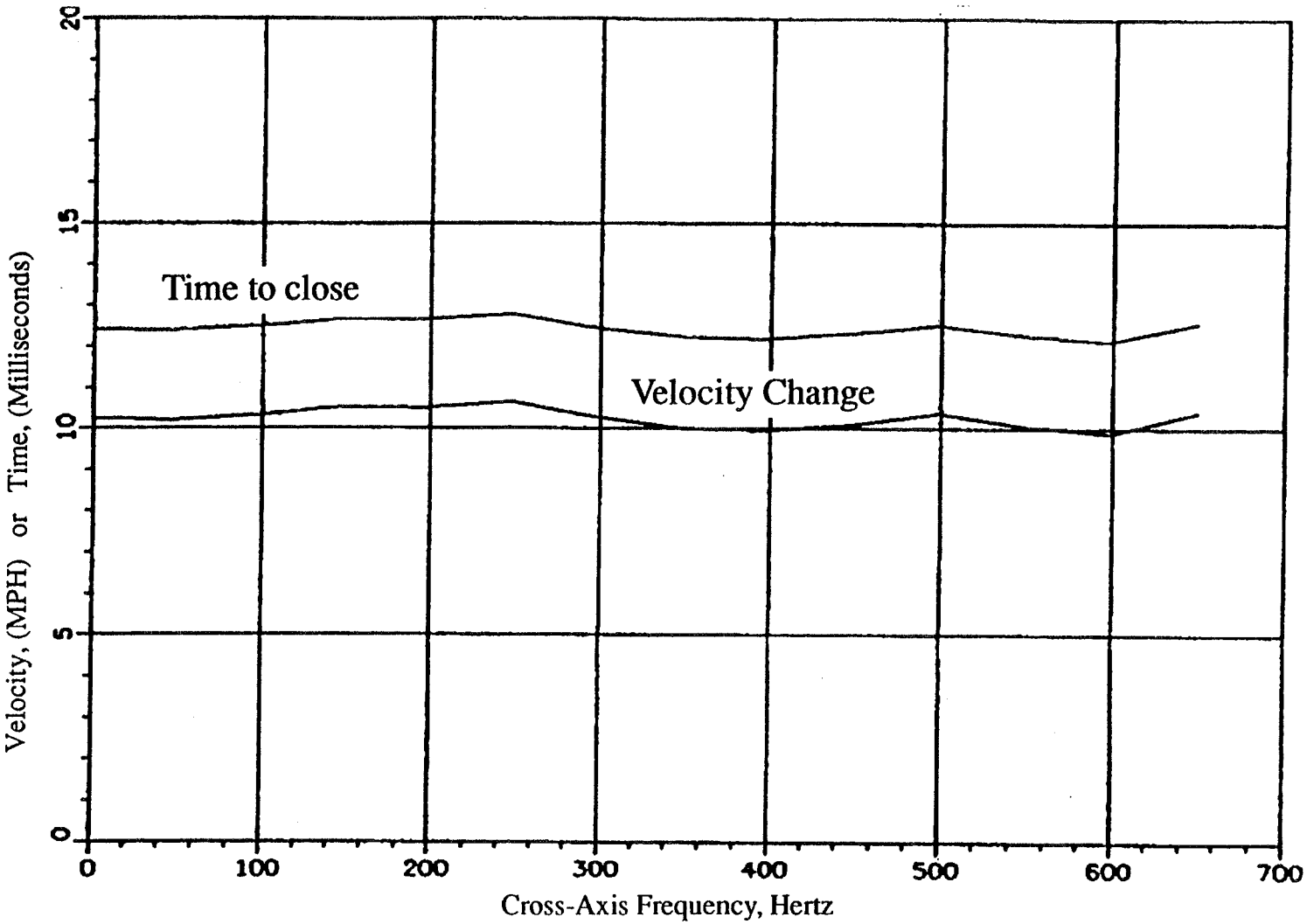
FIG. 22*e* is a plot of the velocity change and time to close of the sensor of FIG. 17 with isolation frequency of 50 Hz and cylinder excursion of 0.03 inches, when subjected to a haversine acceleration pulse having a period of 20 milliseconds and a velocity change of 14 MPH, and varying cross-axis frequencies and a magnitude of 100 G's.

In FIG. 22*b* the isolation frequency is reduced to 200 Hz and cylinder excursion of 0.05 inches is permitted. In this case the situation is considerably improved but the effects of cross-axis vibrations remain. A significant improvement is shown in FIG. 22*c* where the isolation natural frequency is reduced to 100 Hz. A further reduction to 50 Hz has significant additional benefit as shown in FIG. 22*d*. Almost no change is seen by decreasing the permitted cylinder excursion to 0.03 inches. Thus, in the more general case the same benefits from reduced isolation natural frequency and some increase in permitted cylinder excursion is seen. However, a natural frequency as low as 50 Hz begins to get close to the frequency of engine vibrations and therefore could not be used in some vehicles without increased damping.

Figure 23:
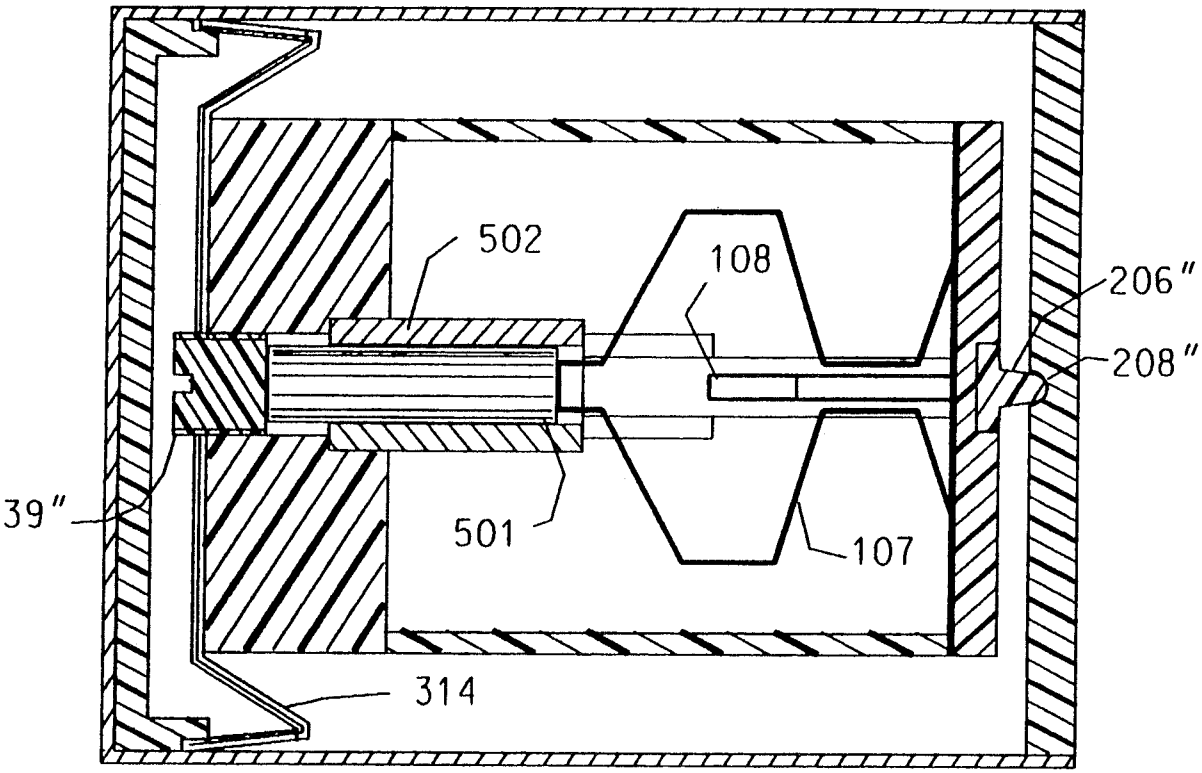
FIG. 23 is a cross sectional view of a crash sensor apparatus similar to FIG. 17 with a cylindrical magnet piston and an electrically conductive sleeve so as to provide magnetic damping to the piston.

FIG. 23 shown an alternate embodiment of the apparatus utilizing magnetic damping. A cylindrical piston 501 made of magnetic material such as Magnaquench ® slides in a cylinder 502 made of a conductive material such as copper during a crash. As the piston moves, eddy currents are induced in the copper tube which dampens the motion of the piston. Cross axis vibration isolation is provided as in FIG. 17. Pivot point 206" and pivot hole 207" perform the same function as corresponding parts 207 and 208 of FIG. 14. Adjustment screw 39" performs the same function as corresponding part 39 in FIG. 4.

There has thus been shown and described an improved gas damped crash sensor which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention which is limited only by the following claims.

What is claimed is:

1. A sensor for detecting a motor vehicle crash, comprising:

(a) a housing;

(b) means for mounting said housing on a motor vehicle, the center of mass of said vehicle defining an inertial frame of reference;

(c) a longitudinal tubular wall defining a passageway within said housing;

(d) a sensing mass arranged tomove within said passageway in the longitudinal direction between a first position and a second position;

(e) means for biasing said sensing mass toward said first position in said passageway;

(f) means responsive to the motion of said sensing mass to said second position in said passageway for detecting a motor vehicle crash; and (g) means for substantially reducing the vibrations of said sensing mass with respect to said inertial frame of reference in directions perpendicular to the longitude during motion of said sensing mass.

2. The crash sensor defined in claim 1, wherein said resilient mounting means is designed such that the natural frequency of vibration, with respect to said inertial frame of reference, of said wall and said sensing mass does not exceed 200 Hertz.

3. The crash sensor defined in claim 1, wherein said biasing means includes a mechanical spring.

4. The crash sensor defined in claim 1, wherein the movement of said sensing mass with respect to said passageway is damped.

5. The crash sensor defined in claim 1, wherein said biasing means includes a mechanical spring, and wherein said spring forms one electrical contact.

6. The invention in accordance with claim 1, wherein the motion of said sensing mass is magnetically damped.

7. The crash sensor defined in claim 1, further comprising means for reducing the angular momentum imparted to said sensing mass during motion of said sensing mass within said passageway.

8. The crash sensor defined in claim 7, wherein said angular momentum reducing means includes a low friction coating on the inner surface of said passageway.

9. The crash sensor defined in claim 8, wherein said low friction coming is Teflon.

10. The crash sensor defined in claim 8, wherein said low friction coating is tungsten disulfide.

11. The crash sensor defined in claim 8, wherein said low friction coating is molybdenum disulfide.

12. The crash sensor defined in claim 7, wherein said angular momentum reducing means includes a low friction coating on the outer surface of said sensing mass.

13. The crash sensor defined in claim 12, wherein said low friction coating is Teflon.

14. The crash sensor defined in claim 12, wherein said low friction coating is tungsten disulfide.

15. The crash sensor defined in claim 1, wherein said vibration reducing means include resilient means disposed mechanically between said vehicle and said wall for resiliently mounting said wall with respect to said vehicle, thereby to isolate said wall and said sensing mass from vibrations perpendicular to the longitude.

16. The crash sensor defined in claim 15, wherein said resilient mounting means comprises resilient material disposed between said housing and said wall.

17. The crash sensor defined in claim 16, wherein said resilient material comprises silicone rubber.

18. The crash sensor defined in claim 16, wherein said resilient material comprises closed-cell foam rubber.

19. The crash sensor defined in claim 16, wherein said resilient material has an elastic modulus which varies less than 4 to 1 over a temperature range from −40 to 160 degrees F.

20. The crash sensor defined in claim 16, wherein said resilient material is Hytrel.

21. The crash sensor defined in claim 15, wherein said resilient mounting means comprises a a plurality of hollow tubes made of elastomeric material and disposed between said housing and said wall.

22. The crash sensor defined in claim 21, wherein said tubes are mounted with their respective axes substantially in parallel with the longitudinal axis of said passageway.

23. The crash sensor defined in claim 21, wherein said resilient mounting means comprises four hollow tubes disposed equilaterally around said passageway.

24. The crash sensor defined in claim 15, wherein said resilient mounting means permits motion of said passageway with respect to said vehicle, in a direction perpendicular to the longitude, of at least 0.020 inches.

25. The crash sensor defined in claim 24, wherein said resilient mounting means permits motion of said passageway with respect to said vehicle, in a direction perpendicular to the longitude, of at least 0.050 inches.

26. The crash sensor defined in claim 15, wherein said vibration reducing means includes means for pivotally mounting said member at one end, and means for resiliently mounting said member at the other end.

27. The crash sensor defined in claim 26, wherein said pivot mounting means includes a projection and a corresponding recess.

28. The crash sensor defined in claim 26, wherein said resilient mounting means imparts an axially directed force to said member in the direction of one end.

29. The crash sensor defined in claim 26, wherein said resilient mounting means include spring means disposed between said member and said housing.

30. The crash sensor defined in claim 29, wherein said spring means comprises at least one flat spring.

31. The crash sensor defined in claim 30, wherein said spring means includes two U-shaped flat springs.

32. A sensor for detecting a motor vehicle crash, comprising:

(a) a housing;

(b) means for mounting said housing on a motor vehicle;

(c) a longitudinal tubular wall defining a passageway within said housing;

(d) a spherical sensing mass arranged to move within said passageway in the longitudinal direction between a first position and a second position;

(e) means for biasing said sensing mass toward said first position in said passageway;

(f) means responsive to the motion of said sensing mass to said second position in said passageway for detecting a motor vehicle crash; and (g) means for reducing the angular momentum imparted to said sensing mass during motion of said sensing mass within said passageway in the longitudinal direction.

33. The crash defined in claim 32, wherein said angular momentum reducing means includes a low friction coating on the inner surface of said passageway.

34. The crash sensor defined in claim 33, wherein said low friction coating is Teflon.

35. The crash sensor defined in claim 33, wherein said low friction coating is tungsten disulfide.

36. The crash sensor defined in claim 32, wherein said angular momentum reducing means includes a low friction coating on the outer surface of said sensing mass.

37. The crash sensor defined in claim 36, wherein said low friction coating is Teflon.

38. The crash sensor defined in claim 36, wherein said low friction coating is tungsten disulfide.

39. In a sensor for detecting a motor vehicle crash, comprising:

(a) a housing;

(b) means for mounting said housing on a motor vehicle;

(c) a longitudinal tubular wall defining a passageway within said housing;

(d) a sensing mass arranged to move within said passageway in the longitudinal direction between a first position and a second position;

(e) means for biasing said sensing mass toward said first position in said passageway; and (f) means responsive to the motion of said sensing mass to said second position in said passageway for detecting a motor vehicle crash; the improvement wherein said biasing means comprises a ribbon spring member having two ends rigidly mounted with respect to one of said vehicle and said wall.

40. The crash sensor defined in claim 39, wherein said two ends of said ribbon spring member are attached to said passageway.

41. The crash sensor defined in claim 39, wherein said two ends of said ribbon spring member are attached to said housing.

42. The crash sensor defined in claim 39, wherein the position of at least one end of said ribbon spring member is adjustable.

43. The crash sensor defined in claim 39, wherein the movement of said sensing mass with respect to said passageway is damped.

44. The crash sensor defined in claim 39, further comprising means for adjusting the location of said first position in said passageway relative to said second position.

45. The crash sensor defined in claim 39, wherein said ribbon spring member exerts a substantially constant nearly constant biasing force on said sensing mass.

46. The crash sensor defined in claim 39, wherein said response means comprises first and second electrical contacts and said ribbon spring member forms said first electrical contact.

47. The crash sensor defined in claim 46, wherein a rigid member forms said second electrical contact.

48. The crash sensor defined in claim 47, wherein the position of said second electrical contact is adjustable.

49. The crash sensor defined in claim 47, wherein a second spring member forms said second electrical contact.

50. The crash sensor defined in claim 49, wherein said second spring member is a second ribbon spring member.

51. The crash sensor defined in claim 50, wherein said first and second ribbon spring members each contain a section which is substantially transverse to the longitudinal direction.

52. The crash sensor defined in claim 51, wherein said transverse sections of said first and second ribbon spring members are substantially transverse to each other.

53. A sensor for detecting a motor vehicle crash, comprising:

(a) a housing;

(b) a longitudinal tubular passageway within said housing;

(c) a sensing mass arranged to move within said passageway in the longitudinal direction between a first position and a second position;

(d) means for biasing said sensing mass toward said first position in said passageway; and (e) means responsive to the motion of said sensing mass to said second position in said passageway;

the improvement wherein said biasing means comprises means for exerting a biasing force on said sensing mass which is substantially constant as said sensing mass moves from said first position to said second position.

54. A sensor for detecting a motor vehicle crash, comprising:

(a) a housing;

(b) a tubular passageway within said housing;

(c) a spherical sensing mass arranged to move within said passageway between a first position and a second position;

(d) means for biasing said sensing mass toward said first positon in said passageway;

(e) means responsive to the motion of said sensing mass to said second position in said passageway;

(f) means for dampening the motion of said sensing mass, said means utilizing the flow of a gas through a tight clearance between said sensing mass and said tubular passageway; and (g) means for testing that said sensor is operational after installation on the vehicle.

55. A sensor for detecting a motor vehicle crash, comprising:

(a) a housing;

(b) a tubular passageway within said housing;

(c) a sensing mass arranged to move within said passageway between a first position and a second position, said sensing mass being susceptible to cross axis vibrations during such motion;

(d) means for biasing said sensing mass toward said first position in said passageway;

(e) means responsive to the motion of said sensing mass to said second position in said passageway;

(f) means for dampening the motion of said sensing mass, said means utilizing the flow of a gas through a tight clearance between said sensing mass and said tubular passageway; and (g) means for substantially reducing the effects of said cross axis vibrations on the operation of said sensor.

56. A sensor for detecting a motor vehicle crash, comprising:

(a) a housing;

(b) a longitudinal tubular passageway within said housing having an internal sliding surface;

(c) a sensing mass having an external sliding surface and arranged to move within said passageway in the longitudinal direction between a first position and a second position;

(d) means for biasing said sensing mass toward said first position in said passageway;

(e) means responsive to the motion of said sensing mass to said second position in said passageway; and (f) a tungsten disulfide coating disposed on at least one of said internal and external sliding surfaces, thereby to reduce the angular momentum imparted to said sensing mass during motion of said sensing mass within said passageway in the longitudinal direction.

* * * * *